United States Patent [19]

Shibahara

[11] Patent Number: 4,923,793

[45] Date of Patent: May 8, 1990

[54] SILVER HALIDE PHOTOGRAPHIC MATERIALS

[75] Inventor: Yoshihiko Shibahara, Kanagawa, Japan

[73] Assignee: Fuji Photo Film Co., Ltd., Kanagawa, Japan

[21] Appl. No.: 274,546

[22] Filed: Nov. 22, 1988

[30] Foreign Application Priority Data

Nov. 26, 1987 [JP] Japan ..... 62-298569

[51] Int. Cl.[5] ..... G03C 1/06

[52] U.S. Cl. ..... 430/567; 430/605; 430/611

[58] Field of Search ..... 430/605, 611, 567

[56] References Cited

U.S. PATENT DOCUMENTS 4,607,004 8/1986 Ikenoue et al. ..... 430/523

4,623,612 11/1986 Nishikawa et al. ..... 430/375

*Primary Examiner*—Paul R. Michl

*Assistant Examiner*—Janet C. Baxter

*Attorney, Agent, or Firm*—Sughrue, Mion, Zinn, Macpeak & Seas

[57] ABSTRACT

A silver halide photographic material, comprising:

at least one negative type silver halide emulsion layer coated onto a support;

at least one compound represented by general formula (I), said compound being included in at least said one emulsion layer; and sensitivity specks present in at least one kind of silver halide grains which are included in the said emulsion layer whereby said sensitivity specks are present within the grains at a depth of at least 2 nm, but less than 50 nm, from the surface of the grains, with the number of said sensitivity speck on the surface of the grains being at least 1/10th, but not more than 5/10ths of the maximum value of sensitivity speck distribution in the depth direction, (I)

wherein, $Z_2$ represents a heterocyclic ring having at least one substituent group selected from the group consisting of $—SO_3M$, $—COOR_2$, —OH and $—NHR_3$, M is selected from the group consisting of hydrogen atom, an alkali metal and an $—NR_4$ group, $R_2$ is selected from the group consisting of a hydrogen atom, an alkali metal and an alkyl group having from 1 to 6 carbon atoms, $R_3$ is selected from the group consisting of a hydrogen atom, an alkyl group having from 1 to 6 carbon atoms, $—COR_4$, $—COOR_4$ and $—SO_2R_4$, and $R_4$ is selected from the group consisting of a hydrogen atom, an aliphatic group which may be substituted and an aromatic group which may be substituted.

6 Claims, No Drawings

SILVER HALIDE PHOTOGRAPHIC MATERIALS

FIELD OF THE INVENTION

This invention is directed toward silver halide photographic materials and, more precisely, it concerns silver halide photographic materials which contain internal latent image type negative type silver halide emulsions which exhibit high sensitivity, excellent graininess and improved storage properties.

BACKGROUND OF THE INVENTION

The requirements of silver halide photographic materials have increased sharply in recent years, and the development of photosensitive materials which exhibit higher sensitivities and excellent graininess is desirable. In order to improve the sensitivity and image quality of silver halide photographic materials it is necessary to improve the light absorption, quantum efficiency and developing properties of the silver halide emulsions.

Silver halide emulsions can be spectrally sensitized utilizing dyes. The absorption of as much dye as possible by the silver halide emulsion is advantageous from the point of view of light absorption. However, the utilization of these dyes serves to reduce the sensitivity of the silver halide emulsion. Therefore, an optimum spectral sensitization is achieved only using a smaller amount of dye than which would form a continuous mono-molecular layer on the surface of the grains in emulsions.

It has long been known that so-called internal latent image type emulsions, that is, emulsions which have chemical ripening specks with which a developable latent image can be formed by exposure to light (referred to below as sensitivity specks) within the grains, are effective as a means of overcoming this problem. For example, it has been indicated in U.S. Pat. No. 3,979,213 that the intrinsic densensitization on color sensitizing an internal latent image type silver halide emulsion is much less than that in the case of a silver halide emulsion of the same grain size which has been chemically sensitized only at the surface, and that as a result it is possible to achieve effective color sensitization using large amounts of sensitizing dye.

Much research has been done with these internal latent image type emulsions in connection with the formation of positive images by development using development baths which have a fogging action, as disclosed in JP-A-55-21067 (the term "JP-A" as used herein means an "unexamined published Japanese patent application"). However, these internal latent image type emulsions are generally such that the latent image is located within the grains at a depth of at least 100 nm from the surface, and thus they cannot be developed in surface development type development baths, such as color negative development baths.

On the other hand, emulsions in which the latent image is located in cavities which open toward the surface of the grains, whereby the desensitization due to the utilization of dyes of the type observed with the internal latent image type emulsions disclosed above is less likely to occur, and which can be developed in practical surface development type development baths, have been disclosed in U.S. Pat. No. 3,966,476.

Methods for the preparation of internal latent image type silve halide emulsions include those in which a fine grained non-chemically sensitized emulsion is mixed with large grains which have been chemically sensitized and the mixture is subjected to Ostwald ripening as disclosed in U.S. Pat. No. 3,206,313, and those in which silver ions and halide ions are added in such a way that they are alternately present in excess to grains which have been chemically sensitized, as disclosed in U.S. Pat. No. 3,917,485. It has been noted that it is possible to control the balance between the surface sensitivity and the internal sensitivity suitably by controlling the thickness of the shell when using these methods of preparation.

However, in general, the sensitivity specks are extremely small crystals of silver sulfide, gold silver sulfide, or silver which are epitaxially bonded to the silver halide crystals. Further, these specks are unstable and thus, changes at the internal latent image sites can occur on handling. This instability results not only in the formation of fog specks but also reduces their function as sensitivity specks. Consequently, it has not been possible to fully realize an increase in sensitivity which could be achieved by the provision of internal latent images.

SUMMARY OF THE INVENTION

The object of the present invention is to provide photosensitive materials which contain internal latent image type, negative type silver halide emulsions which have excellent sensitivity, graininess and storage properties.

The object of the present invention is achieved by means of a silver halide photographic material, comprising:

at least one negative type silver halide emulsion layer coated onto a support;

at least one compound represented by general formula (I), said compound being included in at least said one emulsion layer; and sensitivity specks present in at least one kind of silver halide grains which are included in the said emulsion layer whereby the maximum value of said sensitivity specks is present within the grains at a depth of at least 2 nm, but less than 50 nm, from the surface of the grains, with the number of said sensitivity specks on the surface of the grains being at least 1/10th, but not more than 5/10ths of the maximum value of sensitivity speck distribution in the depth direction,

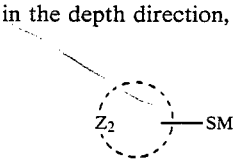

(I)

wherein $Z_2$ represents a heterocyclic ring having at least one substituent group selected from the group consisting of $—SO_3M$, $—COOR_2$, —OH and $—NHR_3$, M is selected from the group consisting of a hydrogen atom, an alkali metal and an $—NH_4$ group, $R_2$ is selected from the group consisting of a hydrogen atom, an alkali metal and an alkyl group having from 1 to 6 carbon atoms, $R_3$ is selected from the group consisting of a hydrogen atom, an alkyl group having from 1 to 6 carbon atoms, $—COR_4$, $—COOR_4$ and $—SO_2R_4$, and $R_4$ is selected from the group consisting of a hydrogen atom, an aliphatic group which may be substituted and an aromatic group which may be substituted.

The invention is described in detail below.

DETAILED DESCRIPTION OF THE INVENTION

The photosensitive materials of the present invention have chemical ripening specks (also known as sensitivity specks) which can form a latent developable image by exposure to light within the grains in at least one emulsion layer (this is known as an internal latent image type emulsion). The embodiment of an internal latent image type emulsion of the present invention is as follows. There is a maximum value in the grain internal latent image distribution, this being located at a depth of at least 2 nm, but less than 50 nm, and preferably at a depth of at least 5 nm, but less than 30 nm, from the grain surface, and the number of latent image sites on the grain surface is at least 1/10th, but not more than 5/10ths, of the above mentioned peak value in the grain internal latent image distribution.

The "grain internal latent image distribution" mentioned here is obtained by plotting the depth (×nm) from the grain surface of the latent image on the abscissa and the number of latent images (y) on the ordinate, and x is given by the following equation.

$$x = \frac{S}{2} \times \left\{ 1 - \left( \frac{Ag_1}{Ag_0} \right)^{\frac{1}{3}} \right\}$$

S: Average grain size (nm) of the silver halide emulsion $Ag_1$: Amount of residual silver after processing an unexposed emulsion coated sample under the conditions indicated below.

$Ag_0$: Coated silver weight before processing.

Moreover, y is the reciprocal of the exposure amount which gives a density of (fog+0.1) when the processing operation indicated below is carried out after exposing the sample to white light for one hundredth of a second.

The processing conditions for obtaining the above mentioned latent image distribution involves adding from 0 to 10 grams per liter of sodium thiosulfate to a processing bath of which the composition is indicated below and then processing the sample for 7 minutes at 20° C.

| Processing Bath | |
|---|---|
| N-Methyl-p-aminophenol sulfate | 2.5 g |
| Sodium L-ascorbate | 10 g |
| Sodium metaborate | 35 g |
| Potassium bromide | 1 g |
| Water | to make up to 1 l |
| pH | 9.6 |

The depth from the surface of the latent image in the silver halide grains which are developed during processing is varied by changing the amount of sodium thiosulfate added to the bath within the range of from 0 to 10 g/l, and it is possible to determine the variation in the number of latent images in the depth direction in this way. The amount of sodium thiosulfate can be selected so as to achieve the optimal processing condition, with considering the grain sizes, compositions, crystal habits, absorbents of the silver halide grains, etc.

In cases where the depth from the surface of the sensitivity specks obtained in the way outlined above is at least 50 nm then adequate development cannot be achieved in the development baths used for black-and-white, color negative, or color reversal type photosensitive materials, and there is an actual desensitization.

Past methods for the preparation of internal latent image type emulsions reported that the ratio of surface sensitivity and internal sensitivity is varied by controlling the thickness of the shell of the grain. However, according to the present results it is clear that the mode of latent image distribution and the ratio of the surface sensitivity and internal sensitivity must be controlled independently by controlling the conditions under which the grains are formed in order to realize the optimum sensitivity for a certain type of processing.

For example, even if the peak value of the latent image distribution occurs at a depth of less than 50 nm, if the latent image distribution at the surface is at least 5/10ths of the peak value then the effect on color sensitization of the internal latent image type emulsion as disclosed in U.S. Pat. No. 3,979,213 is inadequate. Furthermore if the latent image distribution at the surface is less than 1/10th of the peak value then development with practical development baths becomes inadequate and there is an essential desensitization.

On the other hand, it is also clear that the conventional design standard for internal latent image type silver halide grains based only on the difference between the sensitivity when surface development is carried out and the sensitivity when internal development is carried out is inadequate for achieving the optimum sensitivity. That is to say, in cases where the peak of the latent image distribution is located at a depth of at least 50 nm, inadequate development occurs with practical development even if the ratio of the surface sensitivity and internal sensitivity is the same (for example, if the surface sensitivity is the half of the internal sensitivity), and it is impossible to realize the potential optimum sensitivity of the grains.

It is clear that the internal latent image type silver halide grains must be designed with consideration for both the location of the peak in the latent image distribution and the difference between the peak value and the number of latent image sites at the surface in order to realize the optimum sensitivity, as described above.

The term practical development bath mentioned above signifies neither a development bath from which silver halide solvents have been excluded so that only the surface latent image is developed nor a development bath which contains a large amount of silver halide solvent so that it can develop an internal latent image.

The methods disclosed in U.S. Pat. Nos. 3,979,213, 3,966,476, 3,206,313 and 3,917,485, and in JP-B-43-29405 and JP-B-45-13259 (the term "JP-B" as used herein means an "examined Japanese patent publication") can be used to prepare internal latent image type emulsions, but with all of these methods it is necessary to adjust the method of chemical sensitization and amount of silver halide which is precipitated after chemical sensitization, and the precipitation conditions, in order to form an emulsion which has a latent image distribution fallen within the claim scope of the present invention.

In practice, internal latent image type emulsions are prepared using a method in which more silver halide is precipitated, using the controlled double jet method, on the emulsion grains whose surface has been chemically sensitized as in U.S. Pat. No. 3,979,213. If the amount of silver halide which is indicated in this patent is precipitated on the grains then the proportion of surface sensitivity with respect to total sensitivity is inevitably less than 1/10th. Consequently, the amount of silver halide precipitated after chemical sensitization must be less than the amount indicated in U.S. Pat. No. 3,979,213 in order to provide the present latent image distribution.

That is to say, the emulsion is preferably maintained at a pH of from 5.0 to 7.5, and more preferably of from 5.5 to 7.0, during the precipitation of the silver halide on the emulsion grains after chemical sensitization of the grain surface using sulfur sensitization, gold sensitization or reduction sensitization, or using a combination of these methods of sensitization. The conductivity of the emulsion at this time in units of $\mu$mho is preferably within the range from 1000 to 8000, and most desirably within the range from 1500 to 5000. The temperature of the emulsion at this time is preferably within the range from 30° C. to 75° C., and most desirably within the range from 35° C. to 65° C. Furthermore, the pAg of the emulsion at this time is preferably within the range from 7.0 to 10.0, and most desirably within the range from 8.0 to 9.0. The above mentioned conditions are very important from the point of view of controlling the latent image distribution. Moreover, all of the items indicated above are intimately related and it is essential that the conditions should be controlled with good balance.

At least one type of compound represented by the aforementioned general formula (I) is contained in the photosensitive materials of the present invention. Compound similar to that of general formula (I) have also been disclosed in JP-A-55-21067, but $Z_2$ in general formula (I) is a heterocyclic residual group, for example an oxazole ring, a thiazole ring, an imidazole ring, a selenazole ring, a triazole ring, a teterazole ring, a thiadiazole ring, an oxadiazole ring, a pentazole ring, a pyrimidine ring, a thiazine ring, a triazine ring, a thiadiazine ring, or a ring which is bonded to another carbon ring or heterocyclic ring, for example a benzothiazole ring, a benzotriazole ring, a benzimidazole ring, a benzooxazole ring, a benzoselenazole ring, a naphthoxazole ring, a triazaindolidine ring, a diazaindolidine ring, a tetraazaindolidine ring, to which is bonded, either directly or indirectly, at least one group selected from the groups $-SO_3M$, $-COOR_2$, $-OH$ and $-NHR_3$.

The preferred heterocyclic residual groups are an imidazole ring, a tetrazole ring, a benzimidazole ring, a benzselenazole ring, a benzthiazole ring, a benzoxazole ring and a triazole ring.

A tetrazole ring and a triazole ring are the most desirable.

Furthermore, M represents a hydrogen atom, an alkali metal or an $-NH_4$ group, $R_2$ represents a hydrogen atom, an alkali metal or an alkyl group having from 1 to 6 carbon atoms, $R_3$ represents a hydrogen atom, an alkyl group having from 1 to 6 carbon atoms, $-COR_4$, $-COOR_4$ or $-SO_2R_4$, and $R_4$ represents a hydrogen atom, an unsubstituted or substituted aliphatic group, or an unsubstituted or substituted aromatic group, and preferably represents an alkyl group having from 1 to 6 carbon atoms or an aryl group having 6 to 20 carbon atoms, which alkyl and aryl groups each may be substituted with, for example, $-OH$, a halogen atom, $-NH_2$, an alkoxy group having at most 4 carbon atoms or an alkylsulfonyl group having at most 4 carbon atoms.

Actual preferred examples of the compounds (I) of the present invention are indicated below, but the invention is not limited by the examples.

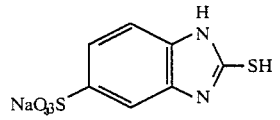
(I-1)

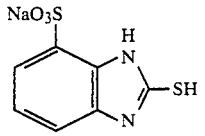
(I-2)

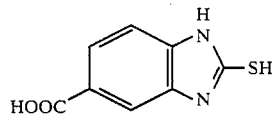
(I-3)

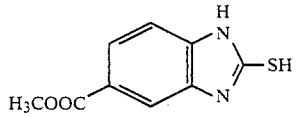
(I-4)

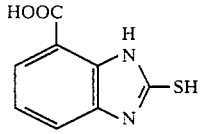
(I-5)

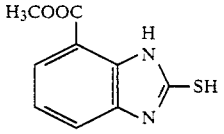
(I-6)

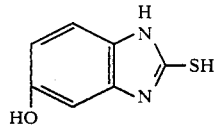
(I-7)

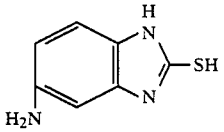
(I-8)

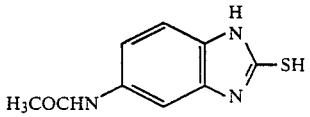
(I-9)

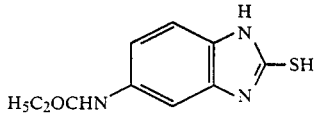
(I-10)

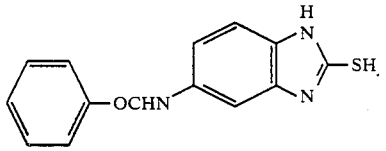
(I-11)

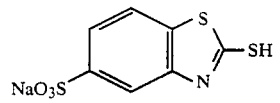
(I-12)

-continued
(I-13)
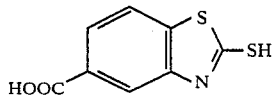
(I-14)
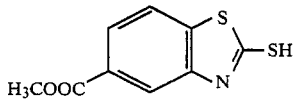
(I-15)
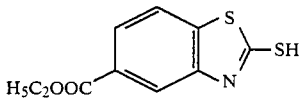
(I-16)
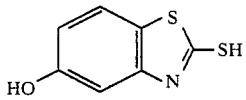
(I-17)
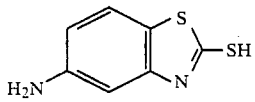
(I-18)
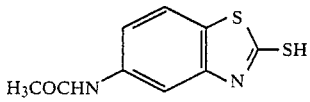
(I-19)
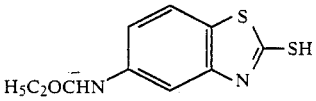
(I-20)
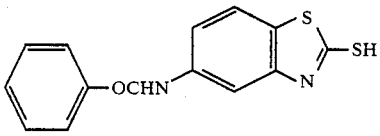
(I-21)
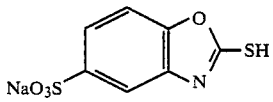
(I-22)
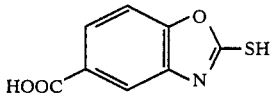
(I-23)
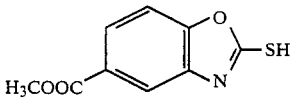
(I-24)
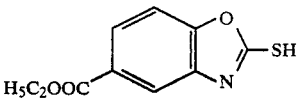
(I-25)
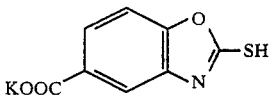
-continued
(I-26)
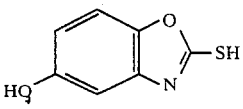
(I-27)
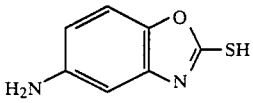
(I-28)
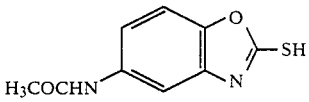
(I-29)
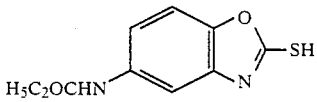
(I-30)
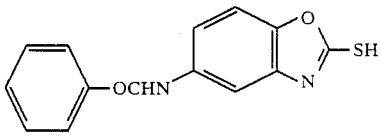
(I-31)
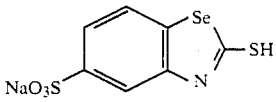
(I-32)
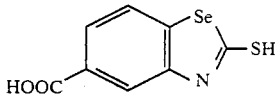
(I-33)
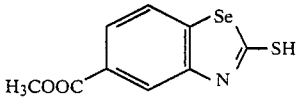
(I-34)
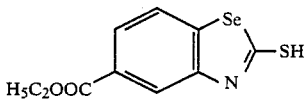
(I-35)
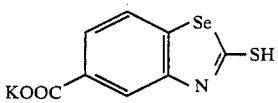
(I-36)
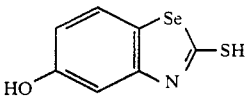
(I-37)
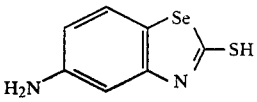
(I-38)
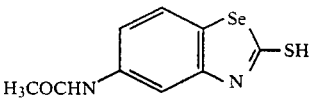

-continued
(I-39)
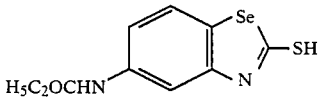
(I-40)
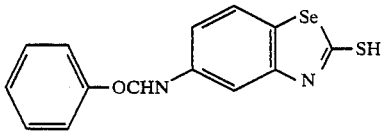
(I-41)
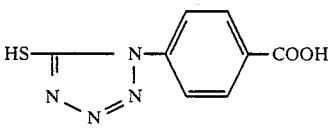
(I-42)
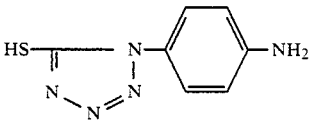
(I-43)
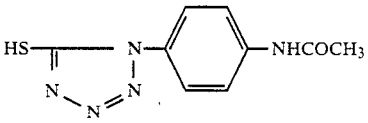
(I-44)
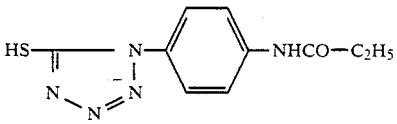
(I-45)
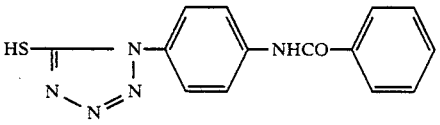
(I-46)
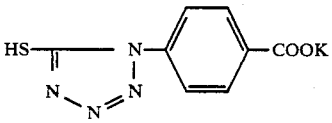
(I-47)
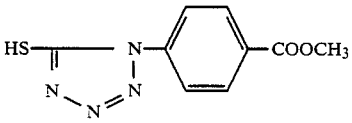
(I-48)
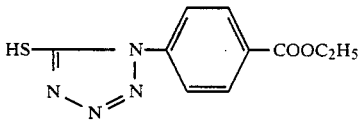
(I-49)
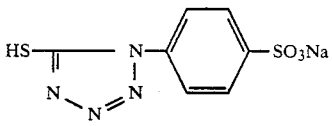
-continued
(I-50)
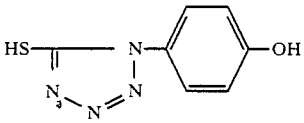
(I-51)
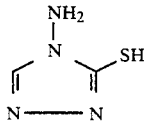
(I-52)
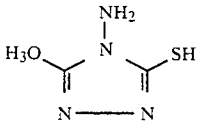
(I-53)
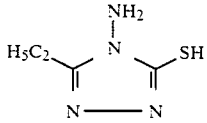
(I-54)
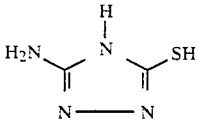
(I-55)
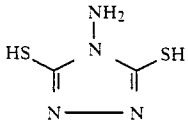
(I-56)
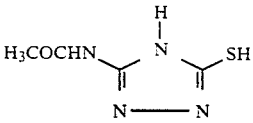
(I-57)
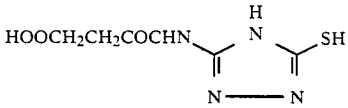
(I-58)
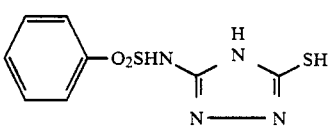
(I-59)
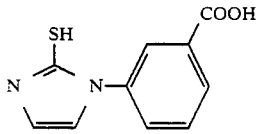
(I-60)
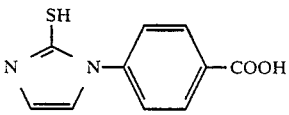
(I-61)
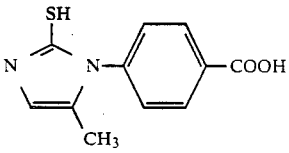

-continued
(I-62)
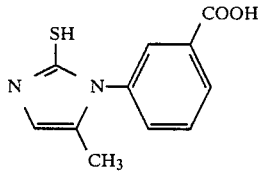
(I-63)
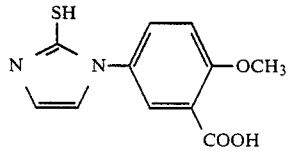
(I-64)
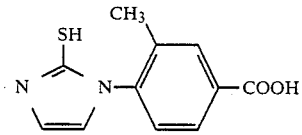
(I-65)
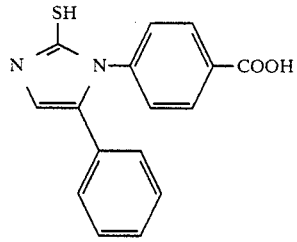
(I-66)
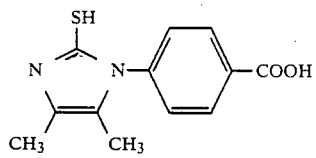
(I-67)
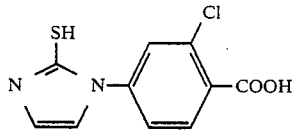
(I-68)
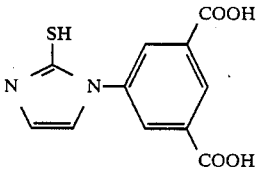
(I-69)
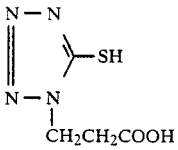
(I-70)
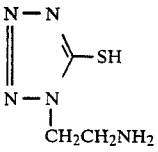
-continued
(I-71)
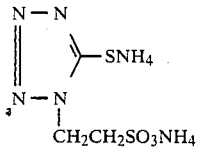
(I-72)
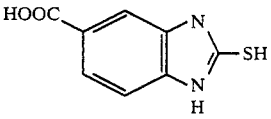
(I-73)
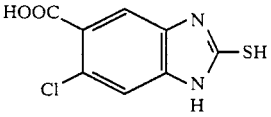
(I-74)
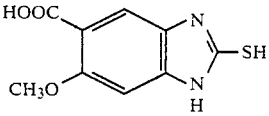
(I-75)
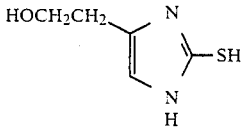
(I-76)
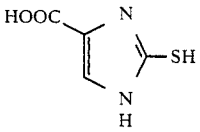
(I-77)
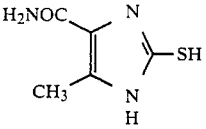
(I-78)
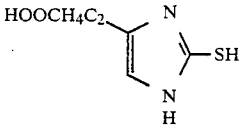
(I-79)
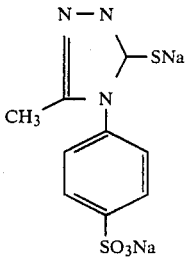
(I-80)
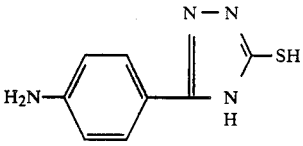
The methods described in the specifications of U.S. Pat. No. 3,226,897 and British Patent No. 1,275,701, by R. G. Dubenko and V. D. Panchenko on pages 199 to 201 of Khim. Getevotsiki Soedin. Sb-1: Azots. odev. Zhaschie Geterotsiky (1967), and by K. Hotmann in part 1, page 384 of *The Chemistry of Heterocyclic Compounds, Imidazole and Its Derivatives*, published by Interscience (1953) can be used to prepare compounds represented by the general formula (I) as mentioned above.

Among these compouds nitrogen containing heterocyclic compounds are preferred in the present invention, and the compounds represented by the general formula (II) below, such as those disclosed in U.S. Pat. No. 1,275,701 and JP-A-No. 61-130343, are the most desirable.

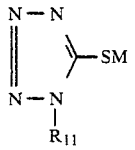
(II)

In this formula, $R_{11}$ represents an aliphatic group, an aromatic group or a heterocyclic group which each is substituted with at least one —$COOR_2$ or —$SO_3M$ group, M represents a hydrogen atom, an alkali metal atom, or a quaternary ammonium group.

Here, the term aliphatic group signifies an aliphatic hydrocarbon group, and includes alkyl groups preferably having 2 to 10 carbon atoms, alkenyl groups and alkynyl groups. The term aromatic group includes an aryl group preferably having 6 to 10 carbon atoms (for example, a phenyl group, a naphthyl group, etc.). The term heterocyclic group signifies a three to eight membered, and preferably a five or six membered, heterocyclic group which has at least one hetero atom, for example, O, N, S, Se, and at least one carbon atom.

$R_{11}$ in the above mentioned general formula (II) is preferably a phenyl group which is substituted with at least one —$COOR_2$ group or —$SO_3M$ group.

Actual example of alkali metals in the above mentioned general formula (II) include sodium, potassium, and lithium. Examples of quaternary ammonium groups include —$NH_4$, —$N(CH_3)_4$, and —$N(C_2H_5)_4$.

The compounds indicated below are actual example of these compounds, but the invention is not limited by the examples.

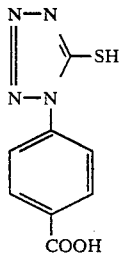
(1)

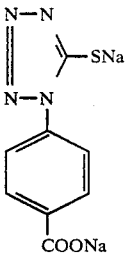
(2)

-continued

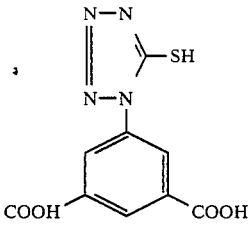
(3)

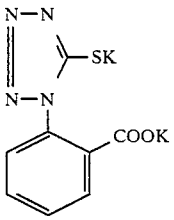
(4)

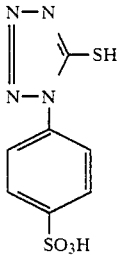
(5)

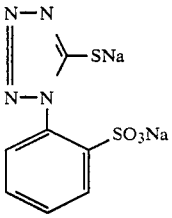
(6)

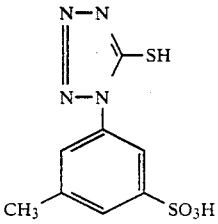
(7)

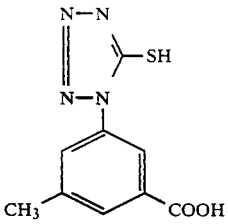
(8)

-continued (9)

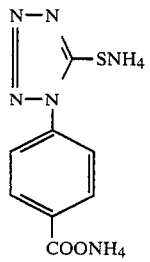

(10)

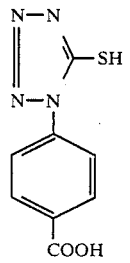

(11)

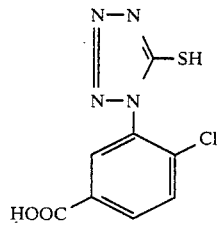

(12)

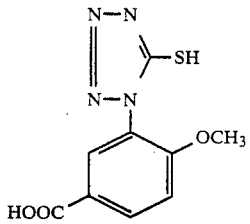

(13)

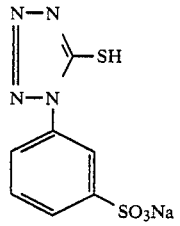

(14)

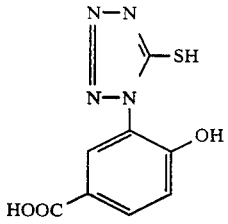

-continued (15)

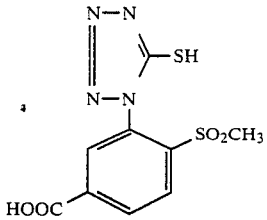

The amount of the compounds represented by the general formulae (I) and (II) which is added is preferably from $10^{-4}$ mol to $10^{-1}$ mol, and more preferably from $10^{-3}$ mol to $5\times10^{-2}$ mol, per mol of silver.

The compounds of general formula (I) or (II) are generally added gradually to the coating solution in the form of a solution in water or alcohol, but any known method can be used for this purpose.

In cases where a compound of general formula (II) is added directly to a photosensitive emulsion layer which contains a sensitizing dye the compound of general formula (II) is preferably added before the addition of the sensitizing dye.

The present emulsions can be subjected to color sensitization using known methods. The amount of sensitizing dye utilized should be that which provides the highest minus blue sensitivity, and this amount is similar to the amount which provides the highest minus blue sensitivity in a surface latent image type emulsion. However, the addition or more dye than this inhibits the development of the grains and is thus undesirable.

The emulsions of the present invention can be used without having been subjected to color sensitization. In this case no effect can be anticipated on color sensitization, but effects are seen in respect of reciprocity characteristics and storage properties.

Any of the silver halides, namely silver bromide, silver iodobromide, silver iodochlorobromide, silver chlorobromide and silver chloride, can be used in the silver halide photographic emulsions to which the present invention is applied. The preferred silver halide is a silver iodobromide or iodochlorobromide which contains not more than about 30 mol % of silver iodide. The most desirable silver halides are silver iodobromides which contain from about 3.0 mol % to about 20 mol % of silver iodide.

The silver halide grains may have a so-called regular crystalline form, such as a cubic, octahedral or tetradecahedral form, or an irregular form such as a tabular or spherical form, or they may be a form which has crystal defects such as twinned crystal planes or they may have a composite form consisting of these forms. However, regular crystals are preferred from the point of view of controlling the latent image distribution. Mixture of various crystalline forms can also be used.

The grain size of the silver halide may be up to 10 $\mu$. For example, the grain size may be very small, i.e. not more than about 0.1 micron, or the grain as may have a large size such that the projected area diameter is as large as about 10 microns. The emulsion may be a monodisperse emulsion which has a narrow grain size distribution or a polydisperse emulsion which has a wide grain size distribution, but monodisperse emulsions are preferred from the viewpoint of improved graininess.

A monodisperse emulsion typically is an emulsion wherein at least 95 wt % of the grains have a grain size within the average grain size ±40%. Emulsions which have an average grain size of from 0.05 to 2 microns and in which at least 95 wt %, or at least 95% (in terms of the number of grains), of the silver halide grains have a grain size within the average grain size ±20% can be used in the invention. Methods for the preparation of emulsions of this type have been disclosed in U.S. Pat. Nos. 3,574,628 and 3,655,394, and in British Patent No. 1,413,748. Furthermore, the use of monodisperse emulsions such as those disclosed in JP-A-No. 48-8600; JP-A-No. 51-39027; JP-A-No. 51-83097; JP-A-No. 53-137133; JP-A-No. 48-48521; JP-A-No. 54-99419; JP-A-No. 58-37635 and JP-A-No. 58-49938 is preferred in the present invention.

The silver halide photographic emulsions for use in the present invention can be prepared using known methods, such as those disclosed in *Research Disclosure*, Volume 176, No. 17643 (Dec. 1978), pages 22 to 23, "I, Emulsion Preparation and Types", and on page 648 of *Research Disclosure*, Volume 187, No. 18716 (Nov. 1979).

The present photographic emulsions can be prepared using the methods described in *Chemie et Physique Photographique*, by P. Glafkides, published by Paul Montel, (1967), in *Photographic Emulsion Chemistry*, by G. F. Duffin, published by Focal Press, (1966); and in *Making and Coating Photographic Emulsions*, by V. L. Zelikman et al., published by Focal Press, (1964). That is to say, they can be prepared using any of the acidic, neutral and ammonia methods, and the reaction between the soluble silver salt and the soluble halide salt can be achieved using a single jet method, a double jet method or any combination of these methods. The methods in which the grains are formed in the presence of an excess of silver ion (the so-called reverse mixing method) can also be used. The method in which the pAg value in the solution in which the silver halide grains are being formed is held constant, which is to say the so-called controlled double jet method, can be used as one type of double jet method. Silver halide emulsions in which the crystal form is regular and the grain size is almost uniform can be obtained using this method.

Physical ripening can be carried out in the presence of known silver halide solvents (for example ammonia, potassium thiocyanate or the thioethers and thione compounds disclosed in U.S. Pat. No. 3,271,157, and in JP-A-No. 51-12360; JP-A-No. 53-82408; JP-A-No. 54-100717 and JP-A-No. 54-155828.

The aforementioned silver halide emulsions can be obtained by adjusting the pAg and pH values during grain formation. Details have been described, for example, in Photographic Science and Engineering, Vol. 6, pages 159 to 165 (1962), in Journal of Photographic Science, Vol. 12, pages 242 to 251 (1964), and in U.S. Pat. No. 3,655,394 and British Patent No. 1,413,748.

Furthermore, tabular grains having an aspect ratio of at least 5 can also be used in the present invention. Tabular grains can be prepared easily using the methods described by Gutoff on Photographic Science and Engineering, Vol. 14, pages 248 to 257 (1970), and in U.S. Pat. Nos. 4,434,226, 4,414,310, 4,433,048 and 4,439,520, and in British Pat. No. 2,112,157. The advantages of using tabular grains are that the covering power is increased and the color sensitization efficiency with sensitizing dyes is increased.

Details regarding the above have been given in U.S. Pat. No. 4,434,226 mentioned above.

The crystal structure of the grains may be uniform, the interior and exterior parts may have a heterogeneous halogen composition, or the grains may have a layered structure. Emulsion grains of these types have been disclosed in British Patent No. 1,027,146, U.S. Pat. Nos. 3,505,068 and 4,444,877, and in JP-A-No. 60-143331. Furthermore, silver halides which have different compositions may be joined with an epitaxial junction or they may be joined to compounds other than silver halides such as silver thiocyanate or lead oxide. Emulsion grains of these types have been disclosed in U.S. Pat. Nos. 4,094,684, 4,142,900 and 4,459,353, British Patent No. 2,038,792, U.S. Pat. Nos. 4,349,622, 4,395,478, 4,433,501, 4,463,087, 3,656,962 and 3,852,067, and in JP-A-No. 59-162540.

The silver halide grains used in the photographic emulsions of the silver halide photographic materials of the present invention preferably have a double structure made up of a core consisting essentially of silver iodobromide which contains at least 5 mol % of silver iodide and a shell part consisting essentially of silver iodobromide which has a lower silver iodide content than the core part, or silver bromide, which covers the core. The silver iodide content of the core is more preferably at least 10 mol %, and most preferably at least 20 mol % but not more than 44 mol %. The silver iodide content of the shell is preferably not more than 5 mol %.

The core preferably has a uniform silver iodide content, but it may have a multiple structure consisting of phases which have different silver iodide contents. In the latter case, the silver iodide content of the phase which has the highest silver iodide content is at least 5 mol %, and more preferably at least 10 mol %, and the silver iodide content of the shell is preferably lower than that of the phase in the core which has the highest silver iodide content. Furthermore, the term "consisting essentially of silver iodobromide" signifies that the part in question consists mainly of silver iodobromide, but up to about 1 mol % may consist of other components.

The more preferred embodiment of silver halide grains for use in the photographic emulsion layers of silver halide photographic materials of the present invention is a grain having a structure which gives rise to a large diffraction peak corresponding to the core part on the diffraction angle vs. diffraction intensity curve for the (220) plane of the silver halide obtained using the $K_\beta$ line of copper in the diffraction angle ($2\theta$) range from 38° to 42°, a large diffraction peak corresponding to the shell part and a minimum between these two peaks, and the diffraction intensity corresponding to the core part is from 1/10 to 3/1, particularly preferably from 1/5 to 3/1, more preferably from 1/3 to 3/1, with respect to the diffraction intensity of the shell part.

The crystal structure may be uniform during the formation of the silver halide grains or in the course of physical ripening, the interior and exterior parts may consist of a heterogeneous halogen composition or they may have a layered structure. Furthermore, silver halides having different compositions may be joined together with an epitaxial junction, or they may, for example, be joined with a substance other than silver halide, for example with silver thiocyanate or lead oxide.

Mixtures of grains of various crystalline forms may also be used.

Additives used in the preparation process of the silver halide emulsions have been disclosed in *Research Disclo-*

*sure*, Nos. 17643 and 18716 and the locations of the said disclosures are summarized in the Table below.

Known photographic additives which can be used in the invention have also been disclosed in the two *Research Disclosures* mentioned above, and the locations of these disclosures are also shown in the Table below.

| Type of Additive | RD 17643 | RD 18716 |
|---|---|---|
| 1. Chemical sensitizers | Page 23 | Page 648, right column |
| 2. Sensitivity increasing agents | | As above |
| 3. Spectral sensitizers Supersensitizers | Pages 23–24 | Pages 648 right column to 649 right column |
| 4. Whiteners | Page 24 | |
| 5. Anti-foggants and Stabilizers | Pages 24–25 | Page 649 right column |
| 6. Light absorbers, filter dyes, UV Absorbers | Pages 25–26 | Pages 649, right column to 650, left column |
| 7. Anti-staining agents | Page 26, right column | Page 650 left–right column |
| 8. Dye image stabilizers | Page 25 | |
| 9. Hardening agents | Page 26 | Page 651, left column |
| 10. Binders | Page 26 | As above |
| 11. Plasticizers, Lubricants | Page 27 | Page 650, right column |
| 12. Coating aids, Surfactants | Pages 26–27 | As above |
| 13. Anti-static agents | Page 27 | As above |

Various color couplers can be used in this invention, and actual examples have been disclosed in the patents disclosed in *Research Disclosure*, (RD) No. 17643, VII-C to G.

Those color couplers disclosed in U.S. Pat. Nos. 3,933,501, 4,022,620, 4,326,024 and 4,401,752, JP-B-No. 58-10739, and in British Patent Nos. 1,425,020 and 1,476,760 are preferred as yellow couplers.

The 5-pyrazolone based and pyrazoloazole based compounds are preferred as magenta couplers, and those disclosed in U.S. Pat. Nos. 4,310,619 and 4,351,897, European Patent No. 73,636, U.S. Pat. Nos. 3,061,432 and 3,725,067, *Research Disclosure*, No. 24220 (Jun., 1984), JP-A-No. 60-33552, *Research Disclosure*, No. 24230 (Jun., 1984), JP-A-Nos. 60-43659 and in U.S. Pat. Nos. 4,500,630 and 4,540,654, are especially desirable.

Phenol based and naphthol based couplers are used as cyan couplers, and those disclosed in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Patent No. 121,365A, U.S. Pat. Nos. 3,446,622, 4,333,999, 4,451,559 and 4,427,767 and in European Patent No. 161,626A are preferred.

The colored couplers disclosed in *Research Disclosure*, No. 17643, section VII-G, U.S. Pat. No. 4,163,670, JP-B-No. 57-39413, U.S. Pat. Nos. 4,004,929 and 4,138,258, and in British Patent No. 1,146,368 are preferred for correcting unwanted absorptions of the colored dyes.

The couplers of which the colored dyes have a suitable degree of diffusibility disclosed in U.S. Pat. No. 4,366,237, British Patent No. 2,125,570, European Patent No. 96,570, and in West German Patent Application (OLS) No. 3,234,533 are preferred.

Typical examples of polymerized dye forming couplers have been disclosed in U.S. Pat. Nos. 3,451,820, 4,080,211 and 4,367,282, and in British Patent No. 2,102,173.

Couplers which release photographically useful residual groups on coupling can also be used preferentially in this invention. The DIR couplers which release development inhibitors disclosed in the patents disclosed in the aforementioned *Research Disclosure*, No. 17643, section VII-F, JP-A-No. 57-151944, JP-A-No. 57-154234 and JP-A-No. 60-184248, and in U.S. Pat. No. 4,248,962 are preferred.

The couplers which imagewise release nucleating agents or development accelerators during development disclosed in British Patent Nos. 2,097,140 and 2,131,188, and in JP-A-No. 59-157638 and JP-A-No. 59-170840 are preferred.

Other couplers which can be used in the light-sensitive materials of the present invention include the competitive couplers disclosed in U.S. Pat. No. 4,130,427, the poly-equivalent couplers disclosed in U.S. Pat. Nos. 4,283,472, 4,338,393, and 4,310,618, the DIR redox compound releasing couplers disclosed in JP-A-No. 60-185950and the couplers that release a dye which restores coloration after elimination as disclosed in European Patent No. 173,302A.

Couplers which release development inhibitors as the development proceeds (the so-called DIR couplers) can be utilized in the present invention.

The DIR couplers which can be used include, for example, those which release a heterocyclic mercapto based development inhibitor as disclosed in U.S. Pat. No. 3,227,554, those which release a benzotriazole derivative as a development inhibitor as disclosed in JP-B-No. 58-9942, the so-called colorless DIR couplers disclosed in JP-B-No. 51-16141, those which release a nitrogen containing heterocyclic development inhibitor with the decomposition of methylol after elimination as disclosed in JP-A-No. 52-90923, those which releases a development inhibitor as a result of a post elimination intramolecular nucleophilic reaction as disclosed in U.S. Pat. No. 4,248,962, those which release a development inhibitor as a result of a post elimination electron transfer via a conjugated system as disclosed in JP-A-No. 56-114946; JP-A-No. 57-56837; JP-A-No. 57-154234; JP-A-No. 57-188035; JP-A-No. 58-98728; JP-A-No. 58-209736; JP-A-No. 58-209737; JP-A-No. 58-209738 and JP-A-No. 58-209740, those which release a diffusible development inhibitor which deactivates the development inhibiting capacity in the development bath as disclosed in JP-A-No. 57-151944 and those which release reactive compounds and which either form development inhibitors during development or which deactivate development inhibitors as disclosed in JP-A-No. 60-182438 and JP-A-No. 60-184248.

From among the DIR couplers mentioned above, the use of development bath deactivating type couplers (the so-called super DIR couplers) typified by those disclosed in JP-A-No. 57-151944, the so-called timing type DIR couplers typified by those disclosed in U.S. Pat. No. 4,248,962 and in JP-A-No. 57-154234, and the reactive type DIR couplers as typified by those disclosed in JP-A-No. 60-184248, is preferred in case of combination use with the present invention and, of these, the use of the development bath deactivating type (the so-called super DIR couplers) typified by those disclosed in JP- A-No. 57-151944 and the reactive type DIR couplers typified by those disclosed in JP-A-No. 60-184248, are especially desirable.
Actual examples of the DIR couplers preferably used in combination with the present invention are indicated below.
D-1
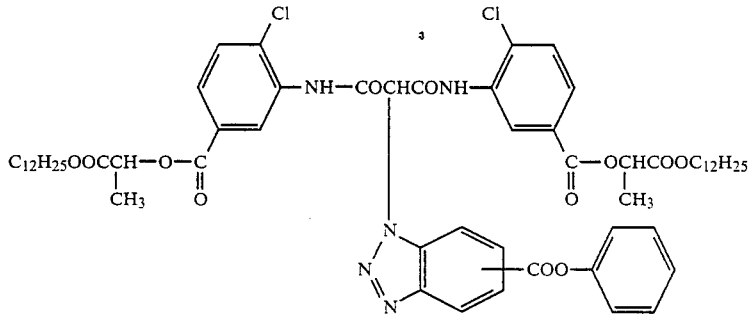
D-2
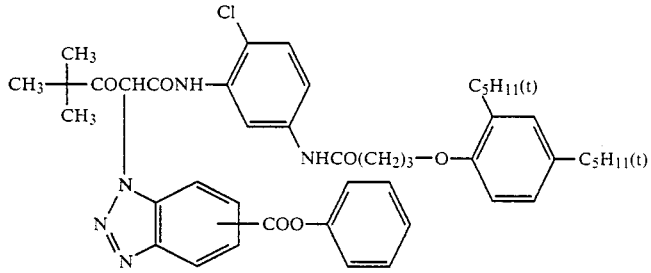
D-3
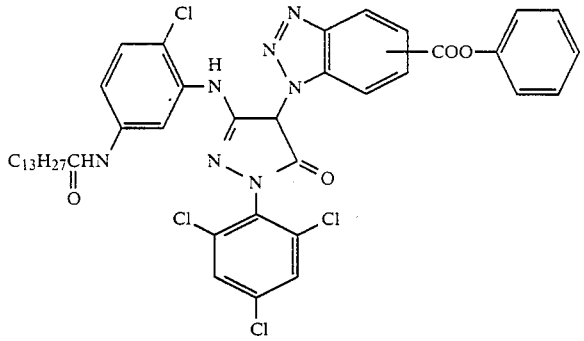
D-4
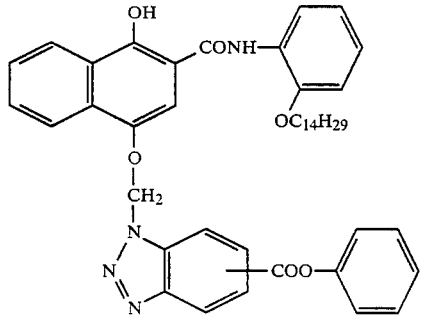
D-5
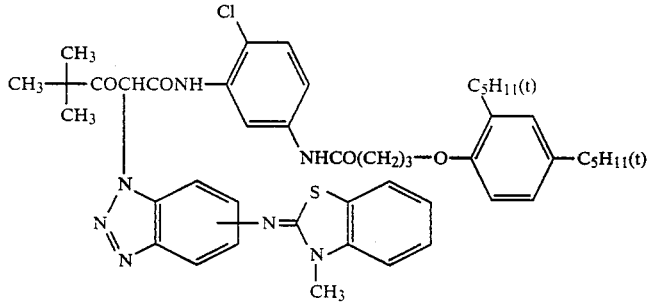

-continued
D-6
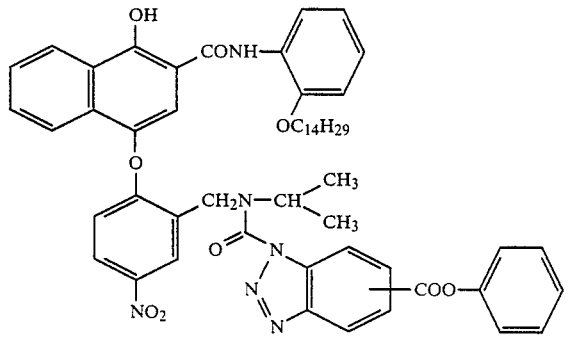
D-7
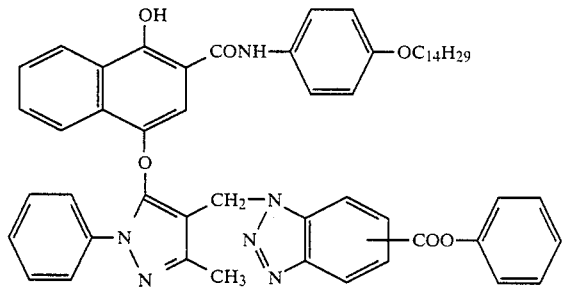
D-8
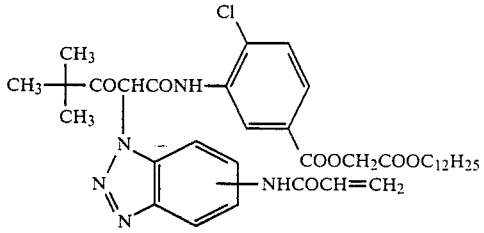
D-9
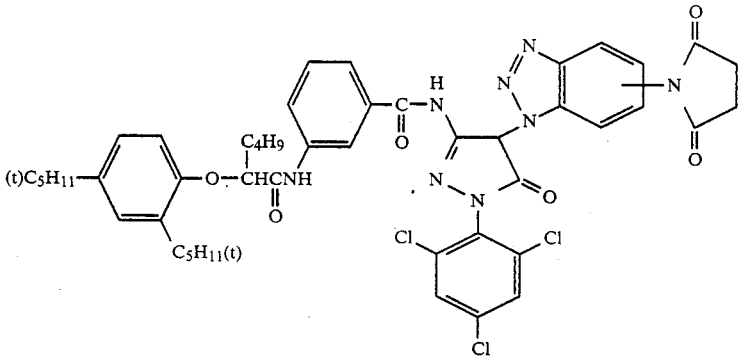
D-10
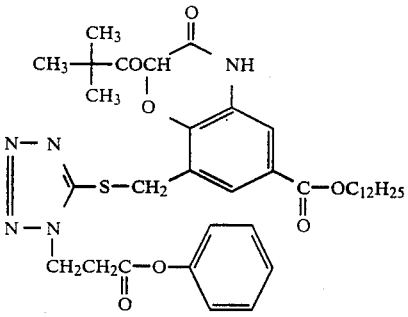

-continued
D-11
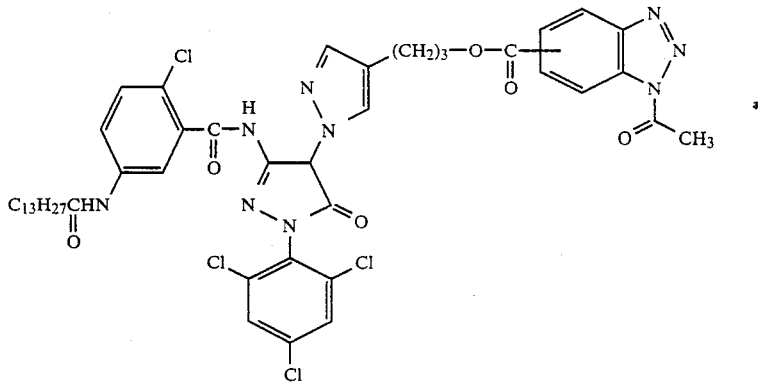
D-12
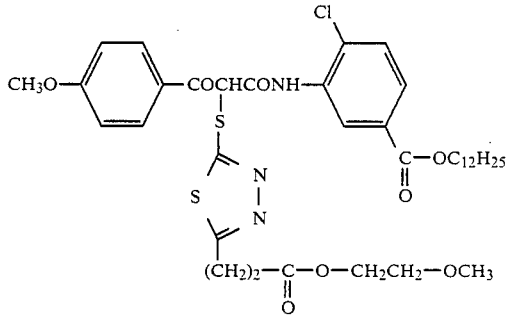
D-13
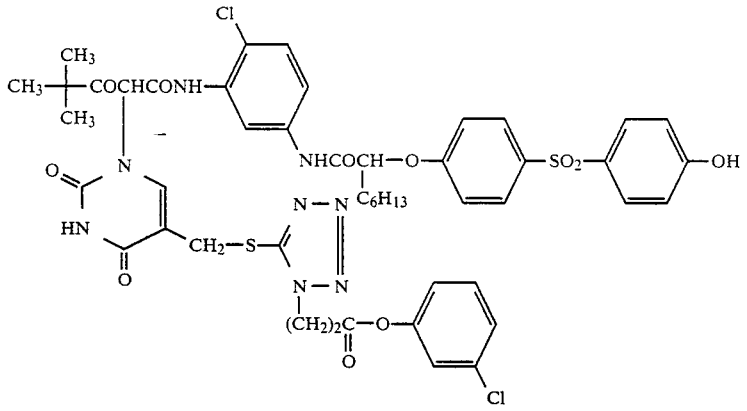
D-14
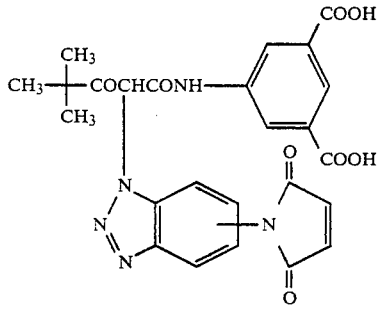
D-15
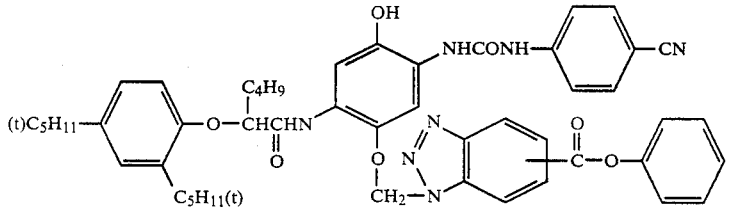

-continued
D-16
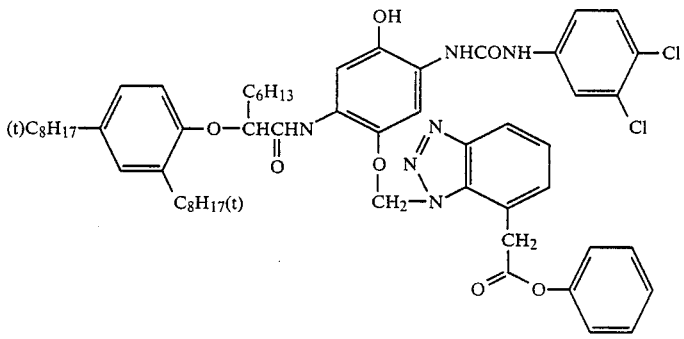
D-17
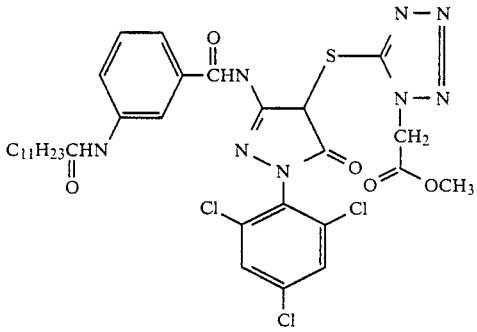
D-18
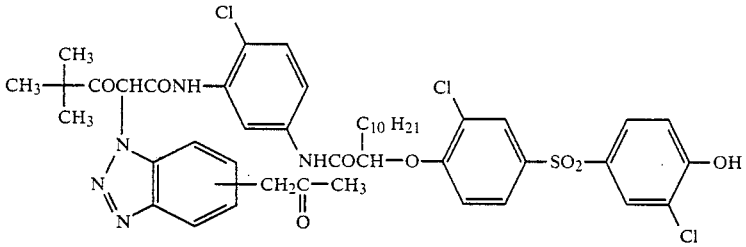
D-19
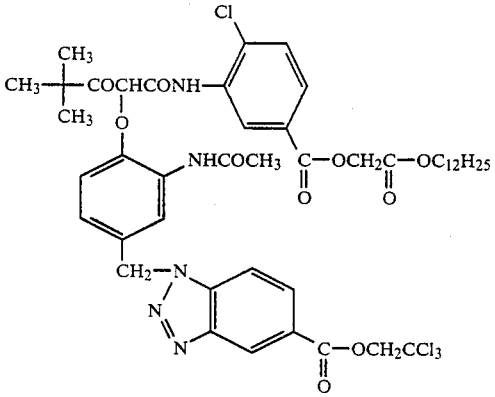
D-20
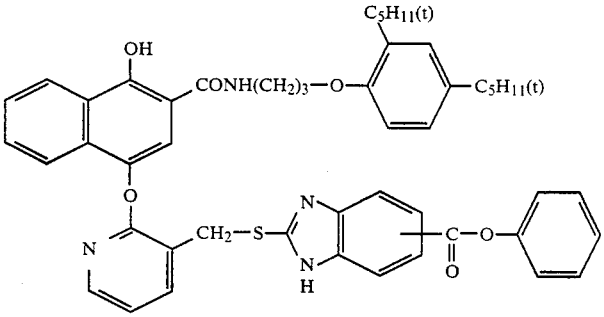

-continued
D-21
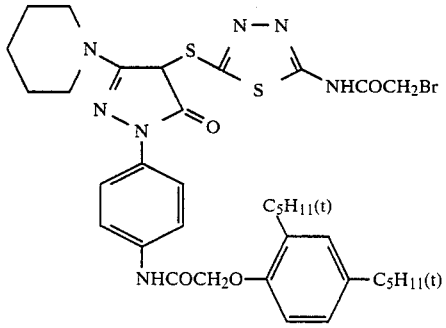
D-22
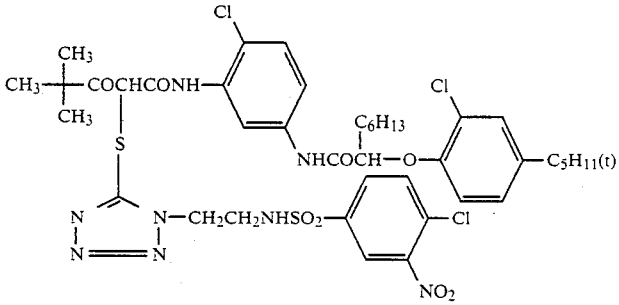
D-23
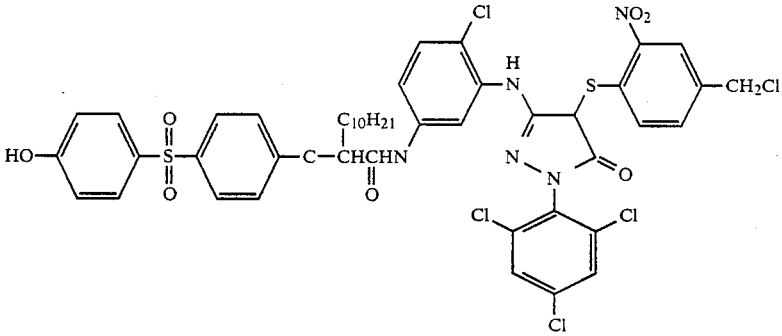
D-24
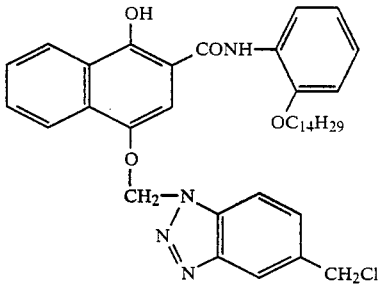

-continued
D-25
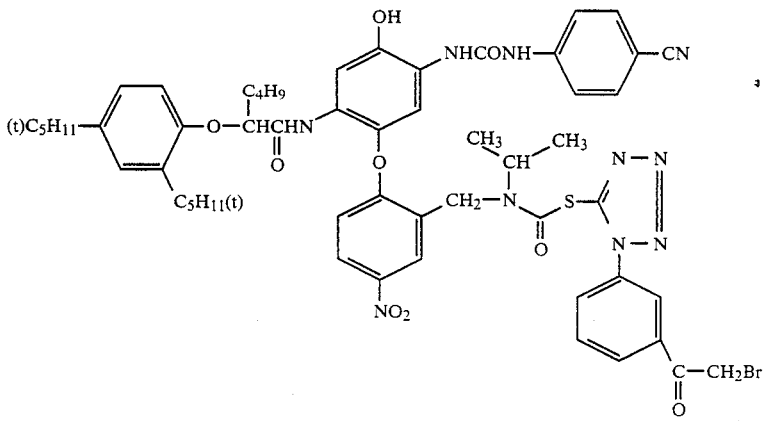
D-26
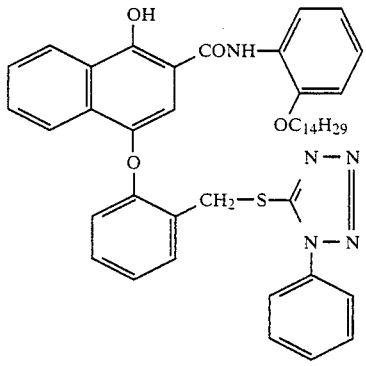
D-27
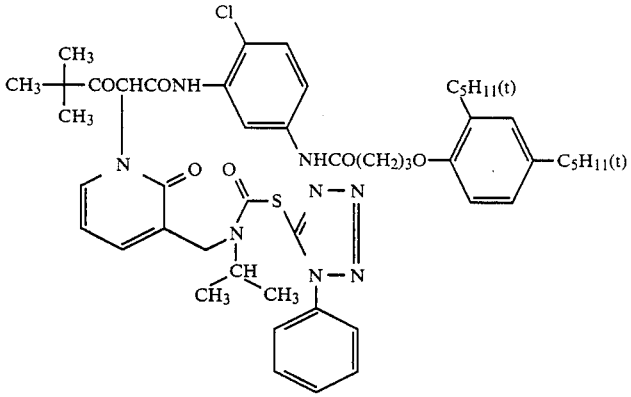
D-28
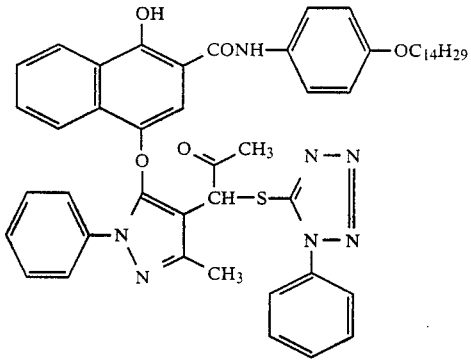

-continued
D-29
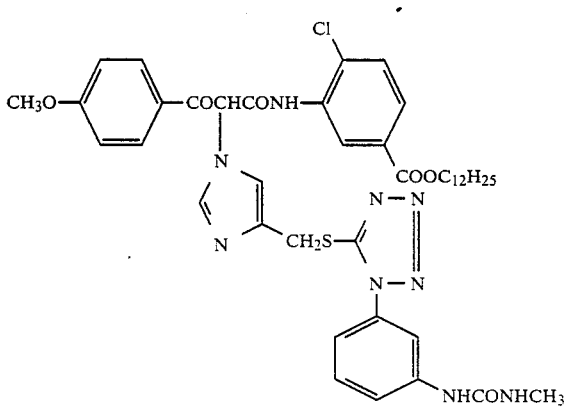
D-30
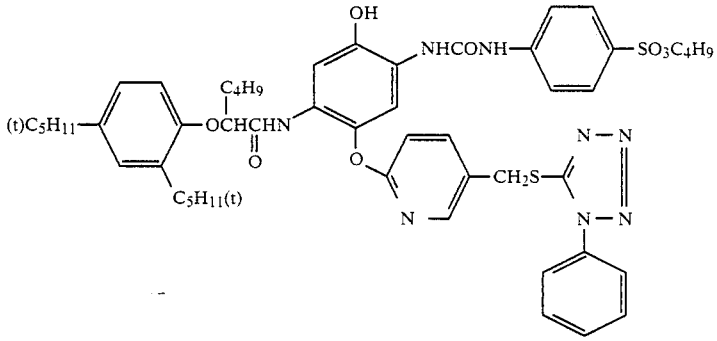
D-31
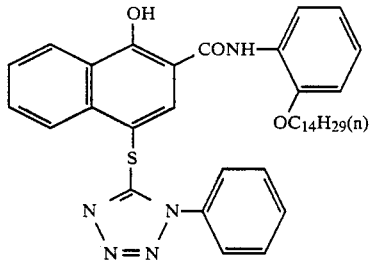
D-32
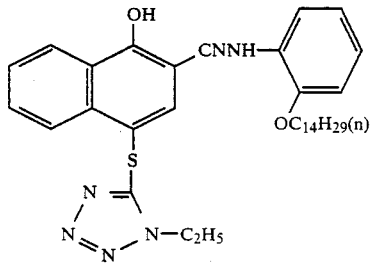

-continued
D-33
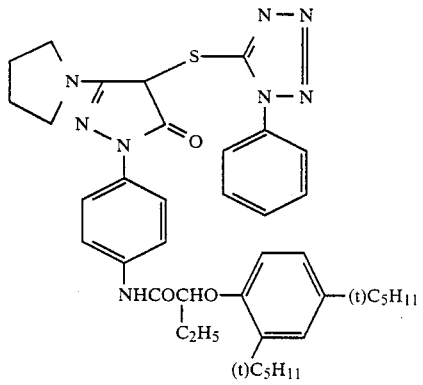
D-34
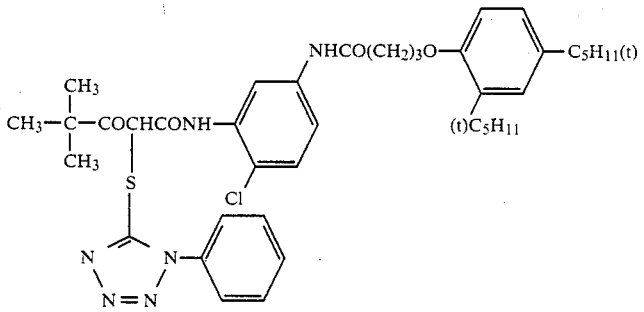
D-35
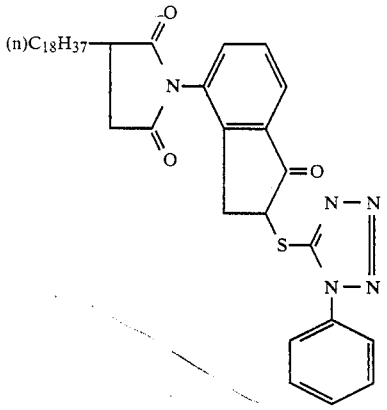
D-36
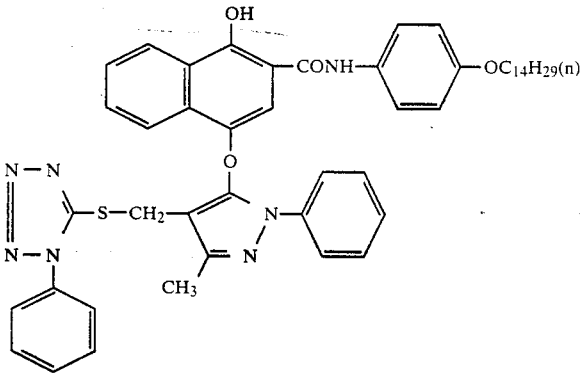

-continued

D-37

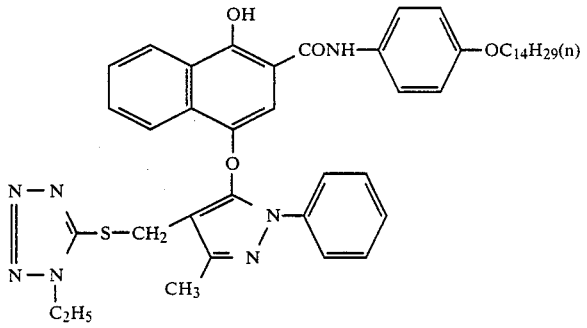

D-38

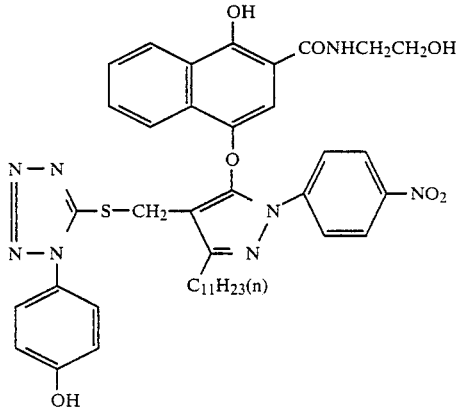

D-39

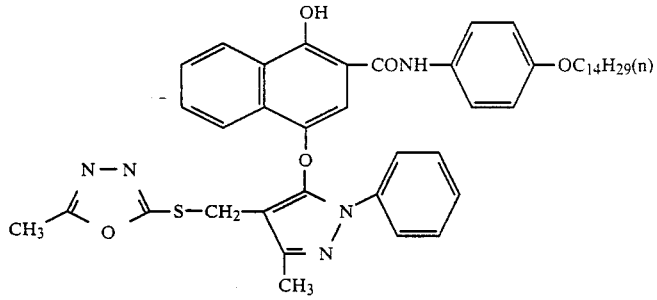

The couplers for use in the present invention can be introduced into the light-sensitive materials by various known methods of dispersion.

Examples of high boiling point solvents which can be used in oil in water dispersion methods are disclosed in U.S. Pat. No. 2,322,027.

The processes and effects of the latex dispersion method, and actual examples of latexes for impregnation purposes, have been disclosed in U.S. Pat. No. 4,199,363, and in West German Patent Application (OLS) Nos. 2,541,274 and 2,541,230.

Suitable supports for use in the present invention have been disclosed, for example, on page 28 of the aforementioned *Research Disclosure*, No. 17643, and from the right hand column of page 647 to the left hand column of page 648 of *Research Disclosure*, No. 18716.

The color photographic materials of the present invention can be developed and processed in accordance with the known methods as disclosed on pages 28 to 29 of the aforementioned *Research Disclosure*, No. 17643, and from the left hand column to the right hand column of page 651 of *Research Disclosure*, No. 18716.

The color photographic materials of the present invention are generally subjected to a water washing or stabilization process after the development and bleach-fixing or fixing processes have been carried out.

The water washing process is generally carried out by countercurrent washing with at least two washing tanks to economize on water. A multi-stage countercurrent stabilization process like that disclosed in JP-A-57-8543 is a typical example of a stabilization process, which can be used instead of a water washing process.

The present invention can be applied to various types of color photosensitive material. Thus, it can be applied to materials typified by color negative films for general purposes or for cinematographic applications, color reversal films for slides or television purposes, color papers, color positive films and color reversal papers. The present invention can also be applied to black-and-white photosensitive materials in which a mixture of tricolor couplers is included, such as those disclosed in *Research Disclosure*, No. 17123 (Jul., 1978).

The following examples further illustrate the present invention in detail, but are not to be construed to limit the scope thereof.

EXAMPLE 1

A monodisperse double structure silver iodobromide emulsion which had an average grain size of 1.1 μm, of which the variation coefficient of the grain size was 14%, and of average silver iodide content of 10 mol %, the grains consisting of a core of average silver iodide content 20 mol % and a shell of average silver iodide content 0%, was prepared in the same way as described in Example 1 of U.S. Pat. No. 4,728,602 to Y. Shibahara et al., columns 9 and 10 (corresponding to Japanese Patent Application No. 248473/83), and after desalting, 1.0 ml of an aqueous solution of chloroauric acid (0.1%) and 2.0 ml of an aqueous solution of sodium thiosulfate (0.1%) were added per mol of silver halide and chemical ripening was carried out. The emulsion obtained was labeled emulsion EM-11.

Moreover, 10 ml of an aqueous solution of silver nitrate (1.00M) and 10 ml of aqueous solution of potassium bromide (1.00M) were added to an amount of the emulsion EM-11 equivalent to 1 mol of silver halide over a period of 2 minutes. The obtained emulsion was labeled emulsion EM-12.

In the same way, 40 ml of an aqueous solution of silver nitrate (1.00M) and 40 ml of an aqueous solution of potassium bromide (1.00M) were added to an amount of the emulsion EM-11 equivalent to 1 mol of silver halide over a period of 5 minutes. The obtained emulsion was labeled emulsion EM-13.

In the same way, 160 ml of an aqueous solution of silver nitrate (1.00M) and 160 ml of an aqueous solution of potassium bromide (1.00M) were added to an amount of the emulsion EM-11 equivalent to 1 mol of silver halide over a period of 20 minutes. The obtained emulsion was labeled emulsion EM-14.

The compound indicated below was added at the rate of $1\times10^{-4}$ mol per mol of silver halide to emulsions EM-11, EM-12, EM-13 and EM-14. The emulsions obtained were called emulsions EM-21, EM-22, EM-23 and EM-24.

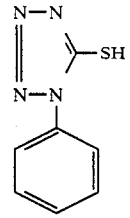

The compound indicated below was added at the rate of $1\times10^{-4}$ mol per mol of silver halide to emulsions EM-11, EM-12, EM-13 and EM-14. The emulsions obtained were called emulsions EM-31, EM-32, EM-33 and EM-34.

(Illustrative Compound (1))

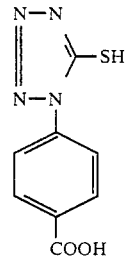

Next, the emulsion layer and protective layer were coated in the amounts shown below on a undercoated triacetylcellulose film support.

(1) Emulsion Layer

*EM-11 to EM-34 as shown in Table 5 ($2.1\times10^{-2}$ mol of silver per square meter)

*Coupler

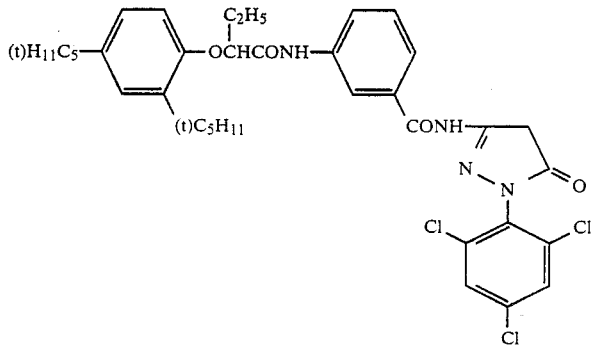

($1.5\times10^{-3}$ mol per square meter) *Sensitizing dye D

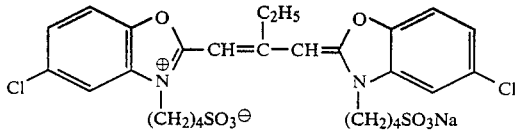

($2.4\times10^{-6}$ mol per square meter) *Sensitizing dye E

-continued

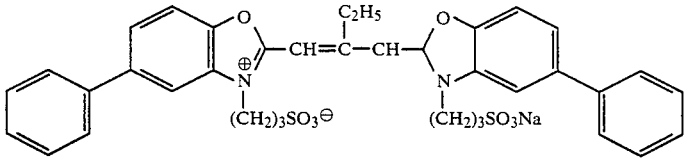

(6.0 × $10^{-6}$ mol per square meter) *Sensitizing dye F

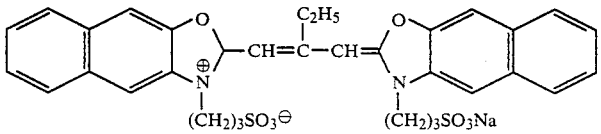

(2.4 × $10^{-6}$ mol per square meter)

These samples were left to stand for 14 hours under conditions of 40° C., 70% relative humidity and then they were exposed for sensitometric purposes and subjected to the color development processing indicated below.

The processed samples were subjected to density measurements using a green filter.

The development processing was carried out as indicated below at a temperature of 38° C.

| | |
|---|---|
| 1. Color Development | 2 minutes 45 seconds |
| 2. Bleaching | 6 minutes 30 seconds |
| 3. Water Wash | 3 minutes 15 seconds |
| 4. Fixing | 6 minutes 30 seconds |
| 5. Water Wash | 3 minutes 15 seconds |
| 6. Stabilization | 3 minutes 15 seconds |

The compositions of the processing baths used in each operation are indicated below.

| | |
|---|---|
| Color Development Bath | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |

-continued

| | |
|---|---|
| 4-(N-Ethyl-N-β-hydroxyethylamino)-2-methylaniline sulfate | 4.5 g |
| Water | to make up to 1 l |
| Bleach Bath | |
| Ammonium bromide | 160.0 g |
| Aqueous ammonia (28%) | 25.0 ml |
| Sodium ethylenediaminetetraacetate ferrate | 130 g |
| Glacial acetic acid | 14 ml |
| Water | to make up to 1 l |
| Fixing Bath | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water | to make up to 1 l |
| Stabilizer Bath | |
| Formalin | 8.0 ml |
| Water | to make up to 1 l |

The results of the sensitometric measurements were as shown in Table 5.

It is clear from Table 5 that with emulsions EM-32 and EM-33 of the present invention there was little fog and the sensitivity was high. With emulsion EM-34 the location of the sensitivity specks was deep and thus, development was inadequate in the development bath described above.

TABLE 5

| | | Latent Image Distribution of the Emulsion | | | Photographic Test Results | |
|---|---|---|---|---|---|---|
| Sample No. | Emulsion No. | Depth of Peak Value | Proportion of Surface Latent Image* | Compound Added | Sensitivity** | Fog |
| 1 (Comp. Ex.) | EM-11 | 0 | 100 | None | 100 | 0.14 |
| 2 (Comp. Ex.) | 12 | 6 nm | 45 | " | 102 | 0.18 |
| 3 (Comp. Ex.) | 13 | 20 nm | 25 | " | 105 | 0.25 |
| 4 (Comp. Ex.) | 14 | 60 nm | 5 | " | 70 | 0.20 |
| 5 (Comp. Ex.) | 23 | 20 nm | 25 | 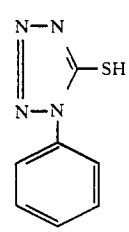 | 41 | 0.14 |

TABLE 5-continued

| Sample No. | Emulsion No. | Latent Image Distribution of the Emulsion: Depth of Peak Value | Latent Image Distribution of the Emulsion: Proportion of Surface Latent Image* | Compound Added | Photographic Test Results: Sensitivity** | Photographic Test Results: Fog |
|---|---|---|---|---|---|---|
| 6 (Comp. Ex.) | 31 | 0 nm | 100 | 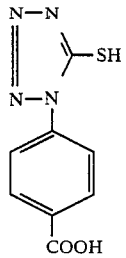 | 105 | 0.10 |
| 7 (Invention) | 32 | 6 nm | 45 | | 120 | 0.11 |
| 8 (Invention) | 33 | 20 nm | 25 | | 140 | 0.12 |
| 9 (Comp. Ex.) | 34 | 60 nm | 5 | | 80 | 0.16 |

*Proportion of Surface Latent Image = (No. of Surface Latent Image Sites)/(Maximum No.
**Sensitivity = Relative value of exposure required to provide a density of fog + 0.1 (Sensitivity for EM-11 taken to be 100)

EXAMPLE 2

Layers of the below indicated compositions were coated in multi-layer fashion onto an undercoated cellulose triacetate film support to provide multilayer color photosensitive materials 201 to 204.

Composition of the Photosensitive Layers

The numerical values corresponding to each component indicate the amounts coated in units of grams per square meter, and in the case of the silver halide the amount coated is indicated as the amount calculated as silver. However, the amounts of sensitizing dyes and couplers coated are shown in units of mols per mol of silver halide in the same layer.

| | |
|---|---|
| First Layer: Anti-halation Layer | |
| Black colloidal silver | as silver 0.18 |
| Gelatin | 1.40 |
| Second Layer: Intermediate Layer | |
| 2,5-Di-t-pentadecylhydroquinone | 0.18 |
| C-1 | 0.07 |
| C-3 | 0.02 |
| U-1 | 0.08 |
| U-2 | 0.08 |
| HBS-1 | 0.10 |
| HBS-2 | 0.02 |
| Gelatin | 1.04 |
| Third Layer: First Red Sensitive Emulsion Layer | |
| Silver iodobromide emulsion (average grain size 0.5 μm, average silver iodide content 4 mol %) | as silver 0.50 |
| Sensitizing dye IX | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| C-2 | 0.146 |
| HBS-1 | 0.005 |
| C-15 | 0.0050 |
| Gelatin | 1.20 |
| Fourth Layer: Second Red Sensitive Emulsion Layer | |
| Silver iodobromide emulsion (average grain size 0.70 μm, average silver iodide content 10 mol %) | as silver 1.15 |
| Sensitizing dye IX | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| C-2 | 0.060 |
| C-3 | 0.008 |
| C-15 | 0.004 |
| HBS-1 | 0.005 |
| Gelatin | 1.50 |

-continued

| | |
|---|---|
| Fifth Layer: Third Red Sensitive Emulsion Layer | |
| Silver iodobromide emulsion (average grain size 1.1 μm, average silver iodide content 20 mol %) | as silver 1.50 |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| C-5 | 0.012 |
| C-3 | 0.003 |
| C-4 | 0.004 |
| HBS-1 | 0.32 |
| Gelatin | 1.63 |
| Sixth Layer: Intermediate Layer | |
| Gelatin | 1.06 |
| Seventh Layer: First Green Sensitive Emulsion Layer | |
| Silver iodobromide emulsion (average grain size 0.4 μm, average silver iodide content 4 mol %) | as silver 0.35 |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| C-6 | 0.120 |
| C-1 | 0.021 |
| C-7 | 0.030 |
| C-8 | 0.025 |
| HBS-1 | 0.20 |
| Gelatin | 0.70 |
| Eighth Layer: Second Green Sensitive Emulsion Layer | |
| Silver iodobromide emulsion (average grain size 0.7 μm, average silver iodide content 10 mol %) | as silver 0.75 |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| C-6 | 0.021 |
| C-8 | 0.004 |
| C-1 | 0.002 |
| C-7 | 0.003 |
| HBS-1 | 0.15 |
| Gelatin | 0.80 |
| Ninth Layer: Third Green Sensitive Emulsion Layer | |
| Silver iodobromide emulsion (see Table 6) | as silver 1.80 |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| C-6 | 0.011 |
| C-1 | 0.001 |
| HBS-2 | 0.69 |
| Gelatin | 1.74 |
| Tenth Layer: Yellow Filter Layer | |
| Yellow colloidal silver | as silver 0.05 |
| 2,5-Di-t-pentadecylhydroquinone | 0.03 |

-continued

| | |
|---|---|
| Gelatin | 0.95 |
| Eleventh Layer: First Blue Sensitive Emulsion Layer | |
| Silver iodobromide emulsion (average grain size 0.5 μm, average silver iodide content 4 mol %) | as silver 0.24 |
| Sensitizing dye VIII | $3.5 \times 10^{-4}$ |
| C-9 | 0.27 |
| C-8 | 0.005 |
| HBS-1 | 0.28 |
| Gelatin | 1.28 |
| Twelfth Layer: Second Blue Sensitive Emulsion Layer | |
| Silver iodobromide emulsion (average grain size 0.8 μm, average silver iodide content 10 mol %) | as silver 0.45 |
| Sensitizing dye VIII | $2.1 \times 10^{-4}$ |
| C-9 | 0.098 |
| HBS-1 | 0.03 |
| Gelatin | 0.46 |
| Thirteenth Layer: Third Blue Sensitive Emulsion Layer | |
| Silver iodobromide emulsion (average grain size 1.3 μm, average silver iodide content 13 mol %) | as silver 0.77 |
| Sensitizing dye VIII | $2.2 \times 10^{-4}$ |
| C-9 | 0.036 |
| HBS-1 | 0.07 |
| Gelatin | 0.69 |
| Fourteenth Layer: First Protective Layer | |
| Silver iodobromide (1 mol % silver iodide, average grain size 0.07 μm) | as silver 0.5 |
| U-1 | 0.11 |
| U-2 | 0.17 |
| HBS-1 | 0.90 |
| Fifteenth Layer: Second Protective Layer | |
| Poly(methyl methacrylate) grains (diameter about 1.5 μm) | 0.54 |
| S-1 | 0.15 |
| S-2 | 0.10 |
| Gelatin | 0.72 |

Gelatin hardening agents H-1 and surfactants were added to each layer in addition to the components indicated above.

Structures of the Compounds used in Example 2:

U-1

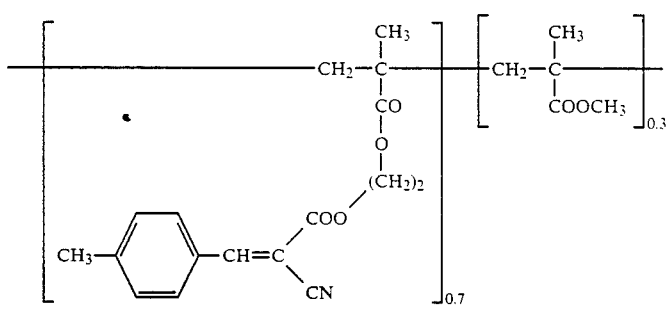

U-2

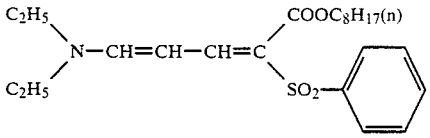

C-1

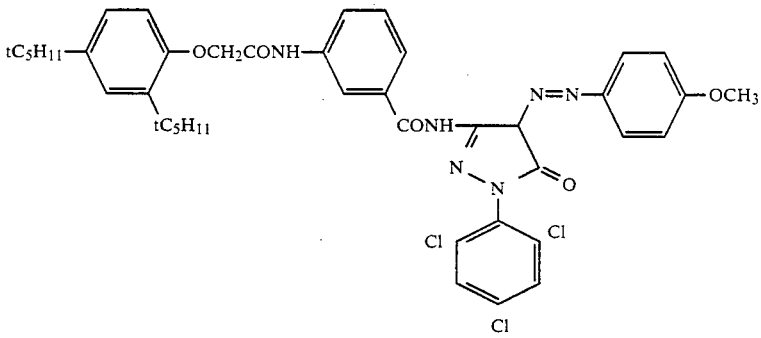

C-2

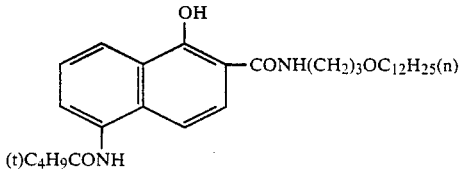

-continued
C-3
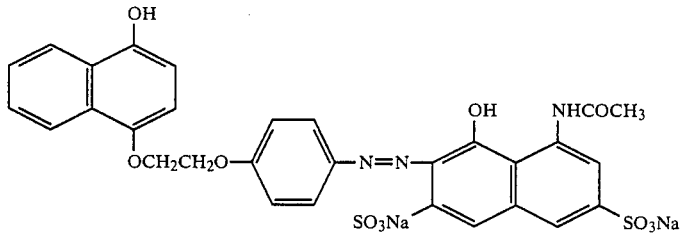
C-4
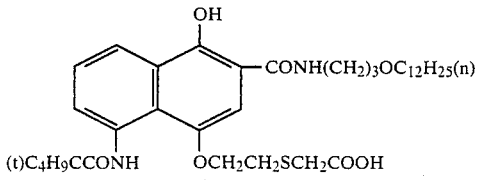
C-5
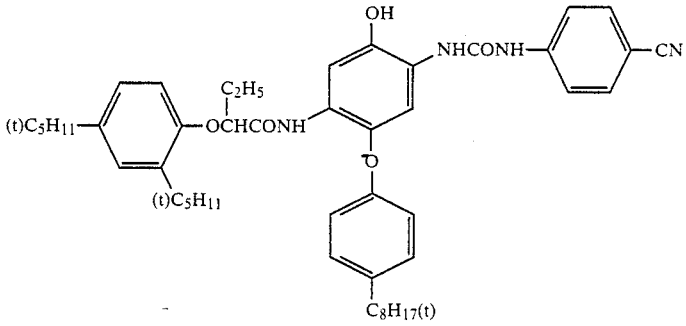
C-6
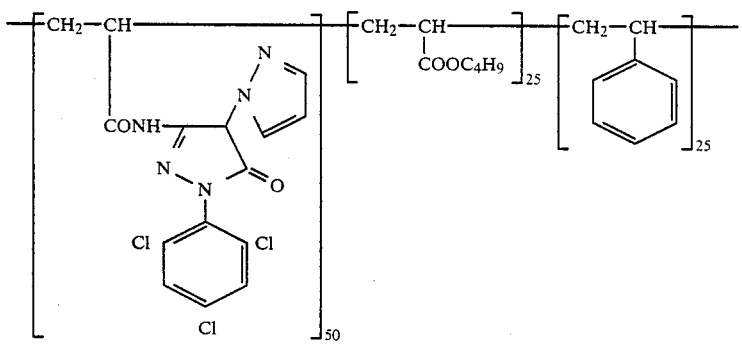
Average Molecular Weight 30,000
C-7
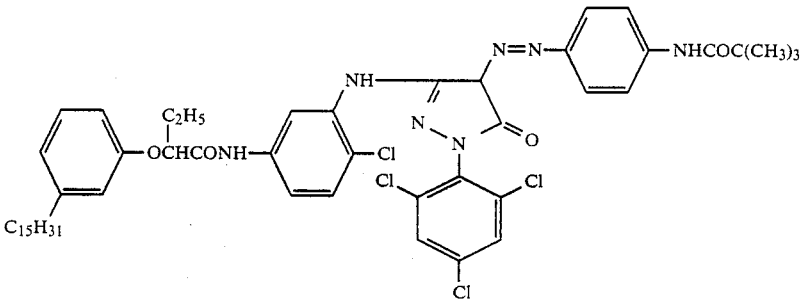

-continued
C-8
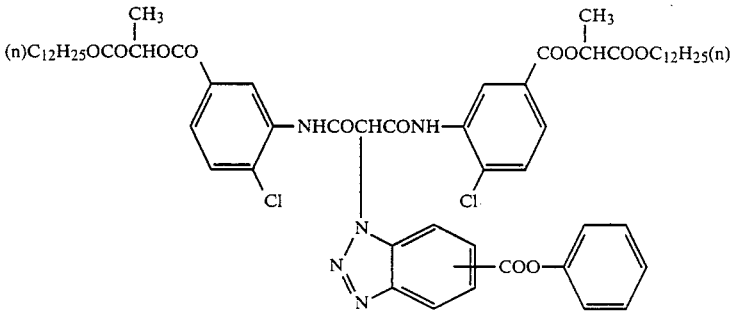
C-9
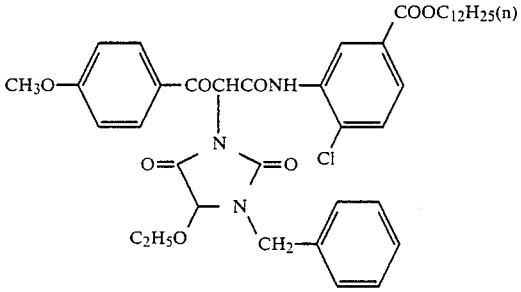
C-15
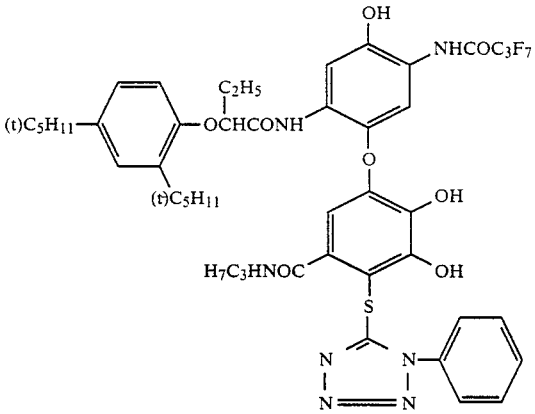
S-1
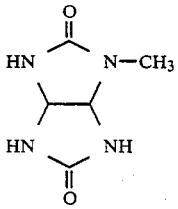
S-2
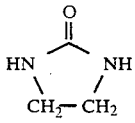
Tricresyl phosphate HBS-1
Dibutyl phthalate HBS-2
H-1
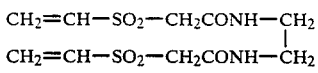
Sensitizing Dyes -continued

II

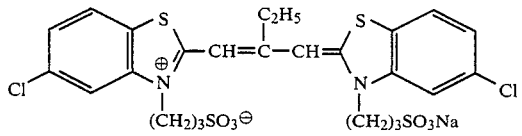

III

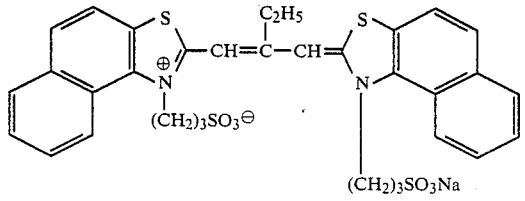

IV

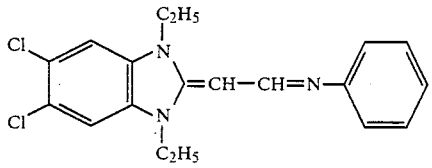

V

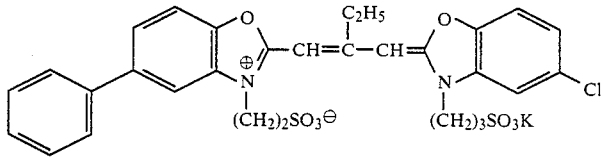

VI

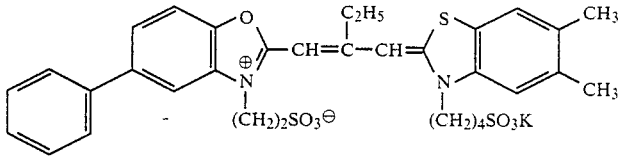

VII

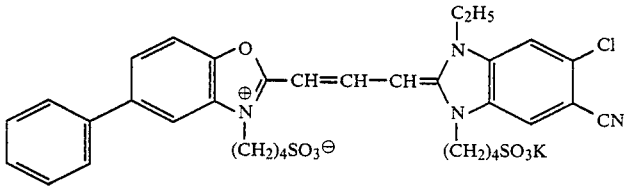

VIII

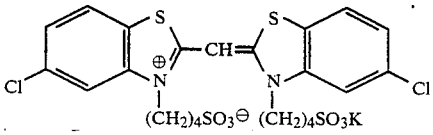

IX

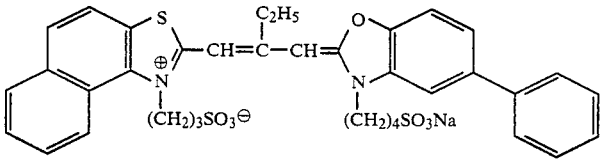

Emulsion EM-201 of the surface latent image type to which no mercapto compounds had been added, emulsion EM-202 of the internal latent image type in which the sensitivity specks were inset to a depth of 20 nm from the grain surface, and emulsion EM-203 obtained by adding a water soluble mercapto compound of the present invention as indicated below at the rate of $10^{-4}$ mol per mol of silver halide to emulsion EM-202 were prepared using the same procedure as in Example 1.

Illustrative Compound (1) of the invention

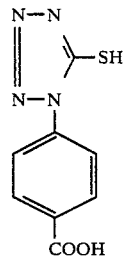

Emulsions EM-201, EM-202 and EM-203, as is clear from the method manufacture in Example 1, contained grains of a double structure with a core which had an iodide content of 10 mol % and a shell consisting of pure silver bromide. Emulsion EM-204 was prepared in such a way that the iodide content of the core and shell in emulsion EM-203 was the same and 5 mol. Samples 201 to 204 were prepared using the emulsions EM-201, EM-202, EM-203 and EM-204 in the third green sensitive layer (Table 6).

Samples 201 to 204 were left to stand for 16 hours under conditions of 40° C., 70% relative humidity, after which they were subjected to sensitometric exposure and developed using the processing method A indicated below. The magenta densities were measured and the extents of fog and the sensitivities (represented as relative values of the reciprocals of the exposures required to give a density of fog+0.2, taking the value for sample 201 to be 100) were as shown in Table 6.

TABLE 6

| Sample No. | Details of Emulsion in the Third Layer: Location of Sensitivity Specks | Halogen Composition: Structure of Grains | Mercapto Compound | Photographic Test Results: Sensitivity | Fog |
|---|---|---|---|---|---|
| 201 (Comparative Example) | Surface Latent Image Type | Double Structure Grains | None Added | 100 | 0.40 |
| 202 (Comparative Example) | Internal Latent Image type (20 nm)** | Double Structure Grains | " | 105 | 0.42 |
| 203 (This Invention) | Internal Latent Image type (20 nm)** | Double Structure Grains | Compound (1) Included | 125 | 0.38 |
| 204 (This Invention) | Internal Latent Image type (20 nm)** | Uniform Structure Grains | Compound (1) Included | 115 | 0.38 |

**The number in brackets indicates the depth from the surface of the sensitivity specks Samples 203 and 204 of the present invention exhibited high sensitivity and little fog.

The effect of the present invention was more pronounced when grains having a double (or multiple) structure with a high iodide phase within the grains were employed in the emulsion.

The effect of the invention was also observed when employing processing methods B and C as indicated below.

| Processing Method A | | |
|---|---|---|
| 1. Color Development | 3 min. 15 sec. | 38.0 ± 0.1° C. |
| 2. Bleaching | 6 min. 15 sec. | 38.0 ± 3.0° C. |
| 3. Water wash | 3 min. 15 sec. | 24 to 41° C. |
| 4. Fixing | 6 min. 30 sec. | 38.0 ± 3.0° C. |
| 5. Water Wash | 3 min. 15 sec. | 24 to 41° C. |
| 6. Stabilization | 3 min. 15 sec. | 38.0 ± 3.0° C. |
| 7. Drying | | Below 50° C. |

The compositions of the processing baths used in each operation were as follows.

| Color Development Bath | |
|---|---|
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |

-continued

| | |
|---|---|
| Potassium iodide | 1.3 mg |
| Hydroxylamine sulfate | 2.4 g |
| 4-(N-Ethyl-N-β-hydroxyethylamino)-2-methylaniline sulfate | 4.5 g |
| Water | to make up to 1 l |
| pH | 10.0 |
| **Bleach Bath** | |
| Ammonium ethylenediaminetetraacetato ferrate | 100.0 g |
| Disodium ethylenediaminetetraacetate | 10.0 g |
| Ammonium bromide | 150.0 g |
| Ammonium nitrate | 10.0 g |
| Water | to make up to 1 l |
| pH | 6.0 |
| **Fixing Bath** | |
| Disodium ethylenediaminetetraacetate | 1.0 g |
| Sodium sulfite | 4.0 g |
| Aqueous ammonium thiosulfate solution (70%) | 175.0 ml |
| Sodium bisulfite | 4.6 g |
| Water | to make up to 1 l |
| pH | 6.6 |
| **Stabilizer Bath** | |
| Formalin (40%) | 8.0 ml |
| Polyoxyethylene-p-monononylphenyl ether (average degree of polymerization 10) | 0.3 g |
| Water | to make up to 1 l |

| Processing Method B | | | |
|---|---|---|---|
| Process | Processing Time | Processing Temperature (°C.) | Replenishment Rate (ml) |
| Color Development | 3 min. 15 sec. | 38 | 45 |
| Bleaching | 1 min. 00 sec. | 38 | 20 |
| Bleach-fixing | 3 min. 15 sec. | 38 | 30 |
| Water Wash (1) | 40 sec. | 35 | Counter-current from (2) to (1) |
| Water Wash (2) | 1 min. 00 sec. | 35 | 30 |
| Stabilization | 40 sec. | 38 | 20 |
| Drying | 1 min. 15 sec. | 55 | |

Replenishment rates per 1 meter length × 35 mm wide

The compositions of the processing baths were as follows.

| | Parent Bath (grams) | Replenisher (grams) |
|---|---|---|
| Color Development Bath | | |
| Diethylenetriaminepentaacetic acid | 1.0 | 1.1 |
| 1-Hydroxyethylidene-1,1-diphosphonic acid | 2.0 | 2.2 |
| Sodium sulfite | 4.0 | 4.9 |
| Potassium carbonate | 30.0 | 42.0 |
| Potassium bromide | 1.6 | — |
| Potassium iodide | 2.0 mg | — |
| Hydroxylamine | 2.4 | 3.6 |
| 4-(N-Ethyl-N-β-hydroxyethylamino)-2-methylaniline sulfate | 5.0 | 7.3 |
| Water to make up to | 1 l | 1 l |
| pH | 10.00 | 10.05 |
| Bleach Bath (Common parent bath and replenisher) | | |
| Ammonium ethylenediaminetetraaceto ferrate | 120.0 g | |
| Disodium ethylenediaminetetraacetate | 10.0 g | |
| Ammonium nitrate | 10.0 g | |
| Ammoniumbromide | 100.0 g | |
| Bleach accelerator | $5 \times 10^{-3}$ mol | |

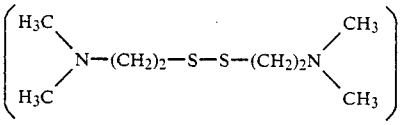

| | |
|---|---|
| Aqueous ammonia to | pH 6.3 |
| Water to make up to | 1 l |

Wash Water

Town water was treated by passing through a mixed bed column packed with an H-type strongly acidic cation exchange resin ("Diaion SK-1B", made by Mitsubishi Kasei Co.) and an OH-type strongly basic anion exchange resin ("Diaion SA-10A", made by the same company) to provide water of the quality indicated below, after which 20 mg/liter of sodium dichloroisocyanurate was added as disinfectant.

| | |
|---|---|
| Calcium ion | 1.1 mg/l |
| Magnesium ion | 0.5 mg/l |
| pH | 6.9 |

| Stabilizer Bath | Parent Bath (grams) | Replenisher (grams) |
|---|---|---|
| Formalin (37% W/V) | 2.0 ml | 3.0 ml |
| Polyoxyethylene-p-monononylphenyl ether (average degree of polymerization 10) | 0.3 | 0.45 |
| Disodium ethylenediaminetetraacetate | 0.05 | 0.07 |
| Water | to make up to 1 l | 1 l |
| pH | about 6.0 | about 6.0 |

Processing Method C

| Process | Processing Time | Temperature (°C.) | (ml) | Replenishment Rate |
|---|---|---|---|---|
| Color Development | 3 min. 15 sec. | 38 | | 38 |
| Bleaching | 6 min. 30 sec. | 38 | | 33 |
| Water Wash | 2 min. 10 sec. | 30 | | 1200 |
| Fixing | 4 min. 20 sec. | 38 | | 33 |
| Water Wash (2) | 1 min. 05 sec. | 30 | } | 1220 |
| Water Wash (3) | 2 min. 10 sec. | 30 | } | |
| Stabilization | 1 min. 05 sec. | 38 | | 33 |
| Drying | 5 min. | 50 | | |

Replenishment rates per 1 meter length × 35 mm wide. Water washes (2) and (3) arranged as a counter-current system from (3) to (2).

The compositions of the processing baths were as follows.

| | Parent Bath (grams) | Replenisher (grams) |
|---|---|---|
| Color Development Bath | | |
| Diethylenetriaminepentaacetic acid | 1.0 | 1.1 |
| 1-Hydroxyethylidene-1,1-diphosphonic acid | 2.0 | 2.2 |
| Sodium sulfite | 4.0 | 4.4 |
| Potassium carbonate | 30.0 | 32.0 |
| Potassium bromide | 1.4 | 0.7 |
| Potassium iodide | 1.3 mg | |
| Hydroxylamine sulfate | 2.4 | 2.6 |
| 4-(N-Ethyl-N-β-hydroxyethylamino)-2-methylaniline sulfate | 4.5 | 5.0 |
| Water | to make up to 1.0 l | 1.0 l |
| pH | 10.0 | 10.05 |
| Bleach Bath | | |
| Ammonium bromide | 160 | 180 |
| Ammonium ethylenediaminetetraacetato ferrate (hydrate) | 110 | 130 |
| Disodium ethylenediaminetetraacetate (hydrate) | 10 | 11 |
| Ammonium nitrate | 30 | 33 |
| Aqueous ammonia (28%) | 7 ml | 5 ml |
| Water | to make up to 1 l | 1 l |
| pH | 6.0 | 5.7 |
| Fixing Bath | | |
| Ammonium thiosulfate solution (70% W/V) | 170 ml | 200 ml |

-continued

| | Parent Bath (grams) | Replenisher (grams) |
|---|---|---|
| Sodium sulfite | 7 | 8 |
| Sodium bisulfite | 5 | 5.5 |
| Disodium ethylenediaminetetra-acetate (dihydrate) | 0.5 | 0.7 |
| Water | to make up to 1 l | 1 l |
| pH | 6.7 | 6.6 |
| Stabilizer Bath | | |
| Formalin (37% W/V) | 2.0 ml | 3.0 ml |
| Polyoxyethylene-p-monononyl-phenyl ether (average degree of polymerization 10) | 0.3 | 0.45 |
| Disodium ethylenediaminetetra-acetate | 0.05 | 0.07 |
| Water | to make up to 1 l | 1 l |
| pH | about 6.0 | about 6.0 |

While the invention has been described in detail and with reference to specific embodiments thereof, it will be apparent to one skilled in the art that various changes and modifications can be made therein without departing from the spirit and scope thereof.

What is claimed is:

1. A silver halide photographic material, comprising:

at least one negative type silver handle emulsion layer coated onto a support;

at least one compound represented by general formula (I); said compound being included in at least said one emulsion layer; and sensitivity specks present in at least one kind of silver halide grains which are included in the said emulsion layer wherein the maximum value of said sensitivity speck distribution in the depth direction is present within the grains at a depth of at least 2 nm, but less than 50 nm, from the surface of the grains, with the number of said sensitivity specks on the surface of the grains being at least 1/10th, but not more than 5/10ths of the maximum value of sensitivity speck distribution in the depth direction,

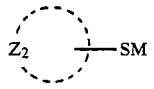

(I)

wherein, $Z_2$ represents a heterocyclic ring having at least one substituent group selected from the group consisting of $—SO_3M$, $—COOR_2$, —OH and $—NHR_3$, M is selected from the group consisting of a hydrogen atom, an alkali metal and an $—NH_4$ group, $R_2$ is selected from the group consisting of a hydrogen atom, an alkali metal and an alkyl group having from 1 to 6 carbon atoms, $R_3$ is selected from the group consisting of a hydrogen atom, an alkyl group having from 1 to 6 carbon atoms, $—COR_4$, $—COOR_4$ and $—SO_2R_4$, and $R_4$ is selected from the group consisting of a hydrogen atom, an aliphatic group which may be substituted and an aromatic group which may be substituted.

2. A silver halide photographic material according to claim 1, wherein said sensitivity specks are present within the grains at a depth of at least 5 nm, but less than 30 nm from the surface of the grains.

3. A silver halide photographic material according to claim 1, wherein said heterocyclic ring is selected from the group consisting of an imidazole ring, a tetrazole ring, a benzimidazole ring, a benzselenazole, a benzothiazole ring, a benzoxazole ring and a triazole ring.

4. A silver halide photographic material according to claim 1, wherein said compound (I) is represented by general formula (II):

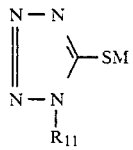

(II)

wherein $R_{11}$ is selected from the group consisting of an aliphatic group, an aromatic group and a heterocyclic group which is substituted with at least one group selected from the group consisting of $—COOR_2$ and $—SO_3M$, and M is selected from the group consisting of a hydrogen atom, an alkali metal atom, and a quaternary ammonium group.

5. A silver halide photographic material according to claim 4, wherein said aliphatic group is selected from the group consisting of an alkyl group, an alkenyl group and an alkynyl group, said aromatic group is selected from the group consisting of a phenyl group and a naphthyl group and said heterocyclic group comprises a 3- to 8-membered ring having at least one hetero atom selected from the group consisting of an oxygen atom, a nitrogen atom, a sulfur atom and a selenium atom, and at least one carbon atom.

6. A silver halide photographic material according to claim 4, wherein said alkali metal is selected from the group consisting of sodium, potassium and lithium and said quaternary ammonium group is selected from the group consisting of $—NH_4$, $—N(CH_3)_4$ and $—N(C_2H_5)_4$.

* * * * *

UNITED STATES PATENT AND TRADEMARK OFFICE

CERTIFICATE OF CORRECTION

PATENT NO. : 4,923,793

DATED : May 8, 1990

INVENTOR(S) : Yoshihiko Shibahara

It is certified that error appears in the above identified patent and that said Letters Patent is hereby corrected as shown below:

Column 57, line 28, please change "handle" to --halide--.

Signed and Sealed this

Twenty-third Day of June, 1992

*Attest:*

DOUGLAS B. COMER

*Attesting Officer*

*Acting Commissioner of Patents and Trademarks*